US006715468B2

(12) United States Patent
Uchiyama et al.

(10) Patent No.: US 6,715,468 B2
(45) Date of Patent: Apr. 6, 2004

(54) FUEL INJECTION SYSTEM

(75) Inventors: Ken Uchiyama, Toyoake (JP); Toshimi Matsumura, Chita-gun (JP)

(73) Assignee: Denso Corporation, Kariya (JP)

( * ) Notice: Subject to any disclaimer, the term of this patent is extended or adjusted under 35 U.S.C. 154(b) by 5 days.

(21) Appl. No.: 10/286,757

(22) Filed: Nov. 4, 2002

(65) Prior Publication Data

US 2003/0084871 A1 May 8, 2003

(30) Foreign Application Priority Data

Nov. 7, 2001 (JP) ..... 2001-341620
Nov. 19, 2001 (JP) ..... 2001-353508

(51) Int. Cl.[7] ..... F02M 55/00

(52) U.S. Cl. ..... 123/339.15; 123/456; 123/457; 123/479

(58) Field of Search ..... 123/447, 456, 123/457, 458, 479, 339.15

(56) References Cited

U.S. PATENT DOCUMENTS 4,531,490 A * 7/1985 Kishi et al. ..... 123/339.15
4,884,545 A * 12/1989 Mathis ..... 123/447
5,080,061 A * 1/1992 Nishimura ..... 123/339.15
5,577,479 A * 11/1996 Popp ..... 123/447
5,738,063 A * 4/1998 Pfuhl et al. ..... 123/456
6,142,120 A * 11/2000 Biester et al. ..... 123/458
6,655,357 B2 * 12/2003 Murakami et al. ..... 123/339.15

FOREIGN PATENT DOCUMENTS

JP 5-52146 3/1993
JP 2000-274297 10/2000

* cited by examiner

*Primary Examiner*—Erick Solis
(74) *Attorney, Agent, or Firm*—Nixon & Vanderhye P.C.

(57) ABSTRACT

An excessive volume of fuel discharged by a high-pressure supply pump to a common rail due to an opened state abnormality of an inlet metering valve of the pump may result in an abnormal increase in common rail pressure. In the event of such an abnormal increase, a target idle revolution speed is newly set at an abnormal value greater than a normal value as a measure taken to increase an idle revolution speed. Thus, a pressure limiter, which has been once put in an opened valve state by an actual common rail pressure higher than a limit setting pressure, can be prevented from again entering a closed valve state. As a result, it is possible to eliminate idle performance instability caused by repetition of opened valve and closed valve states of the pressure limiter and, hence, assure reliability of the pressure limiter.

19 Claims, 14 Drawing Sheets

FUEL INJECTION SYSTEM

CROSS REFERENCE TO RELATED APPLICATION

This application is based on Japanese Patent Applications No. 2001-341620 filed on Nov. 7, 2001 and No. 2001-353508 filed on Nov. 19, 2001 the contents of which are incorporated herein by reference.

BACKGROUND OF THE INVENTION

1. Field of the Invention

The present invention relates to a fuel injection system that has a safety valve for keeping fuel pressure below a predetermined pressure, specifically, the present invention provides a method of and apparatus for executing a failsafe control when the safety valve is activated.

2. Description of Related Art

Generally, a conventional fuel injection system pressurizes fuel and supplies pressurized fuel to cylinder through an injector. In order to keep a fuel pressure within an appropriate range, the fuel injection system may have a safety valve for discharging pressurized fuel from an accumulator or the like when the fuel pressure exceeds a predetermined pressure. The safety valve may be called as a pressure suppresser, a relief valve or a pressure limiter. The safety valve enters an opened state in response to a fuel pressure exceeding the limit setting pressure.

A common rail type fuel injection system is known as a fuel injection system for diesel engines. The common rail type fuel injection system handles high-pressure fuel. Therefore, it is required not only to keep fuel pressure within a predetermined appropriate range, but also to keep the engine running even if the safety valve is activated.

A high-pressure supply pump accumulates high-pressure fuel in a common rail serving as an accumulator by applying a pressure to the fuel in an operation called a pressure feed operation. The high-pressure fuel accumulated in the common rail is then distributed to a plurality of injectors each provided on a cylinder employed in a multi-cylinder engine. The high-pressure fuel distributed to the injectors is finally injected and supplied into a combustion chamber. An inlet metering valve provided at the inlet of the high-pressure supply pump. The inlet metering valve is used for changing and adjusting fuel volume discharged by the high-pressure pump to the common rail by adjusting the intake volume of fuel introduced into the inlet of the high-pressure supply pump. The high-pressure pump is driven by the engine.

A pressure limiter is provided on at least one of a fuel pipe connecting the high-pressure supply pump to the injectors and the common rail. The pressure limiter discharges fuel from the fuel pipe or the common rail to decrease the fuel pressure when the fuel pressure in the fuel pipe and the common rail exceeds a predetermined limit pressure. Such an abnormally excess pressure may be caused by a malfunction on the inlet metering valve. For example, if the inlet metering valve is completely opened due to a mechanical malfunction or a short circuiting, the high-pressure supply pump feeds excessive amount of fuel into the common rail and raises the fuel pressure. The pressure limiter prevents excessive increase of the fuel pressure and assures the reliability of the common rail type fuel injection system.

That is, in a completely opened state of the inlet metering valve with the multi-cylinder engine rotating at an idle revolution speed, the pressure limiter enters an opened valve state because the pressure of fuel in the common rail exceeds the limit setting pressure, letting fuel flow from the fuel pipe and the common rail to the low-pressure side so that the pressure of fuel decreases to a level not higher than the limit setting pressure. As a result, it is possible to assure the reliability of the common rail type fuel injection apparatus.

With the conventional common rail type fuel injection apparatus, however, in an idle state with a small pump fed volume, the pressure limiter enters an opened valve state and a closed valve state alternately in a repeated manner. For example, due to a small pump fed volume, the common rail pressure may swing between an open pressure and a close pressure of the pressure limiter during the engine is operated under an idling state as shown in FIG. 7. Thus, the pressure of fuel in the common rail and the fuel injection volume become unstable, raising a problem of the engine's rotational instability. At the same time, the increased number of times the pressure limiter enters an opened valve state and a closed valve state alternately causes spring fatigue and a bad seal seat, raising a problem of impossibility to assure reliability of the pressure limiter.

In addition, if the inlet metering valve provided at the inlet of the high-pressure supply pump is an electromagnetic valve of the normally closed type, a breakage of a wiring harness connecting a pump driving circuit to the inlet metering valve results in no fuel discharged from the high-pressure supply pump so that it is impossible to sustain a common rail type fuel pressure and a fuel injection volume, which are required to operate the multi-cylinder engine. As a result, there is raised a problem called an engine stall.

In the case of a normally open electromagnetic valve employed as the inlet metering valve, the high-pressure supply pump supplies fuel at an excessively high pressure or at a maximum flow rate in the event of an abnormality as shown in time charts of FIGS. 13 and 14. Examples of the abnormality are an abnormality of a completely open state of the inlet metering valve and an abnormality of a completely closed state of the inlet metering valve. The abnormality of a completely open state of the inlet metering valve is typically caused by a broken wire harness for supplying a pump drive signal from an electronic control unit (ECU) to the inlet metering valve or an abnormality of control executed by the ECU. On the other hand, the abnormality of a completely closed state of the inlet metering valve is typically caused by a foreign substance inadvertently between a valve body and a valve seat of the inlet metering valve.

In the conventional common rail fuel injection system, however, a fuel discharge caused by a valve opening operation of the pressure limiter and a fuel leakage caused by an abnormality and/or a failure of a high-pressure pipe route cannot be distinguished from each other. An example of the abnormality and/or the failure of a high-pressure pipe route is a burst of a high-pressure pipe. For example, a fuel discharge caused by an opened valve state of the pressure limiter may be detected as a fuel leakage by leakage detection logic as shown in the time charts of FIGS. 13 and 14, and a failsafe measure such as an operation to stop the engine is taken. However, there is raised a problem of the driver's excessively aroused anxiety. When the pressure limiter is put in an opened valve state due to an excessive pressure applied by the high-pressure supply pump, for example, it is desirable to let the vehicle continue its running state so as to realize the limp home running of the vehicle.

SUMMARY OF THE INVENTION

It is thus an object of the present invention to provide a fuel injection system capable of assuring reliability of a pressure safety valve by eliminating idle performance instability caused by operations to open and close the pressure safety valve repeatedly.

It is another object of the present invention to provide a fuel injection system capable of avoiding an engine stall and putting the vehicle in a smooth limp home state in the event of an excessive pressure feed of the high-pressure supply pump.

It is still another object of the present invention to provide a fuel injection system capable of improving reliability and safety by execution of engine control whereby implementation of failsafe control is changed in accordance with the type of a fuel pressure decrease.

It is yet another object of the present invention to provide a fuel injection system capable of improving reliability and safety by identifying an abnormality which may be caused by an operation of a pressure safety valve or a state of an excessively high pressure feed supplied by a high-pressure supply pump from several abnormalities of the fuel injection system, and by providing an appropriate failsafe control.

In accordance with a first aspect of the present invention, when a high-pressure supply pump excessively supplies high-pressure fuel to an accumulator or when an abnormal pressure increase in the accumulator is detected, an idle revolution speed is raised to a value higher than a steady state speed. The fuel discharging performance of the high-pressure supply pump is increased due to the increased idle revolution speed. As a result, a pressure safety valve is maintained in opened state. By eliminating the accumulator's fuel pressure instability caused by operations to open and close the pressure safety valve repeatedly as well as instability of the fuel injection volume and by eliminating instability of the idle performance, reliability deterioration of the pressure safety valve can be reduced. Therefore, the reliability of the accumulator fuel injection system can be improved. An operation to raise the idle revolution speed to a value higher than the steady state speed is equivalent to an operation to increase the fuel injection volume to a value greater than the fuel injection volume at the idle revolution speed in a steady state by at least a predetermined amount. In other words, an operation to raise the idle revolution speed to a value higher than the steady state speed is equivalent to an operation to increase the duration of an injector driving pulse or the width of the injector driving pulse to a value greater than a pulse duration or a pulse width corresponding to the idle revolution speed in a steady state by at least a predetermined duration or width.

The high-pressure supply pump may be provided with a metering valve for adjusting a fuel amount discharged from the high-pressure supply pump. The metering valve may be an inlet metering valve. The inlet metering valve is provided on an inlet side of the high-pressure supply pump. The inlet metering valve adjusts the injection volume of fuel introduced into the high-pressure supply pump so that the volume of fuel discharged from the high-pressure supply pump to the accumulator is adjusted. The metering valve may be a discharged fuel metering valve. The discharged fuel metering valve is provided on the discharge port of the high-pressure supply pump. The discharged fuel metering valve adjusts the volume of fuel discharged from the discharge port of the high-pressure supply pump to the accumulator. The metering valve may be a normally open type valve. The pressure safety valve may be configured to regulate fuel pressure in the common rail when the pressure safety valve itself continuously opens.

In accordance with another aspect of the present invention, an inlet metering valve or a discharged fuel metering valve is used to adjust fuel amount supplied to the accumulator. The inlet metering valve or the discharged fuel metering valve is implemented as a normally open type. The system has a pressure safety valve which has a pressure regulating function capable of sustaining the pressure of fuel in the accumulator at a regulated level in the event of a completely opened state abnormality of the inlet metering valve or the discharged fuel metering valve. Even if the pressure safety valve is once put in an opened state, the vehicle can be put in a limp home state.

The regulated level is a pressure required to put the vehicle in a limp home state in a state of an emergency requiring an urgent rescue such as an excessive pressure feed of high-pressure fuel supplied by the high-pressure supply pump to the accumulator. The regulated level is higher than an injector operating pressure but is such a sufficiently low pressure that a noise, a knocking sound and the like are not generated. The completely opened state abnormality of the inlet metering valve or the discharged fuel metering valve is an excessive pressure feed of high-pressure fuel supplied by the high-pressure supply pump to the accumulator or an abnormal pressure increase in the accumulator.

In accordance with a still another aspect of the present invention, a leakage quantity finding means computes a quantity of a fuel leakage from a high-pressure pipe route on the basis of an engine operating state detected by an engine operating state detection means, a high-pressure supply pump operating state detected by an operating state detection means or the high-pressure pipe route fuel pressure detected by a fuel pressure sensor. If a quantity of a fuel leakage computed by the leakage quantity finding means is greater than a first predetermined value but does not exceed a second predetermined value, a small fuel leakage from the high-pressure pipe route is determined to exist and a failsafe measure such as an action to limit the output of the engine is taken. If a quantity of a fuel leakage computed by the leakage quantity finding means is greater than the second predetermined value, a large fuel leakage from the high-pressure pipe route is determined to exist and a failsafe measure such as an action to stop the engine is taken. Thus, the engine can be controlled by executing the failsafe control in different ways in dependence on the quantity of a fuel leakage. In particular, when a small fuel leakage from the high-pressure pipe route is determined to exist, the engine is not stopped but the output of the engine is limited. Thus, it is possible to allow a running state to continue in order to realize limp home running. When a large fuel leakage from the high-pressure pipe route is determined to exist, the engine is stopped. This is because a large fuel leakage may be conceivably caused by an engine abnormality including an abnormality and/or a failure of the high-pressure pipe route. As described above, an example of an abnormality and/or a failure of the high-pressure pipe route is a burst of a high-pressure pipe. As a result, it is possible to improve the common rail fuel injection system reliability and safety.

In accordance with a yet another aspect of the present invention, a leakage quantity finding means computes a quantity of a fuel leakage from a high-pressure pipe route on the basis of parameters representing at least one of an engine operating state detected by an engine operating state detection means, a high-pressure supply pump operating state detected by an operating state detection means or the high-pressure pipe route fuel pressure detected by a fuel pressure sensor. If a quantity of a fuel leakage computed by the leakage quantity finding means is greater than a predetermined value and the high-pressure pipe route fuel pressure detected by the fuel pressure sensor exceeds a predetermined pressure level, a pressure decrease caused by an opened state of a pressure safety valve or an excessive pressure feed state by the high-pressure supply pump is determined to exist and a failsafe measure such as an action to limit the output of the engine is taken. Thus, if the pressure safety valve is opened in an excessive pressure feed supplied by the high-pressure supply pump, the fuel pressure in the high-pressure pipe route decreases due to an opened state of the pressure safety valve, that is, if a fuel escape exists due to an opened state of the pressure safety valve, the engine is not stopped but the output of the engine is limited. Thus, it is possible to let the vehicle continue its running state so as to realize the limp home running.

If a fuel leakage quantity computed by the leakage quantity finding means is greater than a predetermined value and the high-pressure pipe route fuel pressure detected by the fuel pressure sensor does not exceed a predetermined pressure level, a system abnormality including an abnormality and/or a failure of the high-pressure pipe route is determined to exist, and a failsafe measure such as an action to stop the engine is taken. As described above, an example of an abnormality and/or a failure of the high-pressure pipe route is a burst of a high-pressure pipe. As a result, it is possible to improve the common rail fuel injection system's reliability and safety.

The predetermined pressure level may be a pressure value greater than an upper limit of a range used normally in the fuel injection system but smaller than the pressure safety valve opened state pressure corresponding to a limit setting pressure. Thus, the predetermined pressure level is never equal to a pressure value within the a range used normally in the fuel injection system and never becomes equal to or exceeds the pressure safety valve opened state pressure corresponding to a limit setting pressure. In addition, when the high-pressure pipe route fuel pressure detected by the fuel pressure sensor exceeds the predetermined pressure level, the fuel pressure in the high-pressure pipe route can always be determined to be abnormal. Thus, the control precision of the fuel injection system can be improved without regard to the detection precision of the fuel pressure sensor.

The predetermined pressure level may be set for each vehicle or each engine in accordance with the fuel pressure sensor output characteristic and the pressure safety valve opening characteristic, which vary from vehicle to vehicle or from engine to engine. Thus, since it is possible to set a predetermined pressure level for a vehicle or an engine by considering the particular output characteristic of the fuel pressure sensor of the vehicle or the engine and the particular opening characteristic of the pressure safety valve of the vehicle or the engine, the fuel pressure in the high-pressure pipe route can always be determined to be abnormal when the high-pressure pipe route fuel pressure detected by the fuel pressure sensor exceeds the predetermined pressure level.

An injection volume determination means may be constructed to find an injection volume of fuel injected to an engine from an injector of each cylinder on the basis of the engine operating state detected by an engine operating state detection means whereas a leak quantity determination means computes a quantity of a fuel leak from a high-pressure pipe route on the basis of the engine operating state detected by an engine operating state detection means, the injection volume calculated by the fuel volume determination means and the high-pressure pipe route fuel pressure detected by a fuel pressure sensor. Thus, the quantity of the fuel leak from the high-pressure pipe route can be computed with a high degree of precision.

A leakage quantity finding means may be constructed to compute a quantity of a fuel leakage from a high-pressure pipe route on the basis of an engine operating state detected by an engine operating state detection means, a fuel injection volume calculated by a fuel volume determination means, a fuel pressure fed volume calculated by a pressure fed volume determination means and a fuel leak quantity calculated by a leak quantity determination means. Thus, the quantity of the fuel leakage from the high-pressure pipe route can be computed with a high degree of precision.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Figure 1:
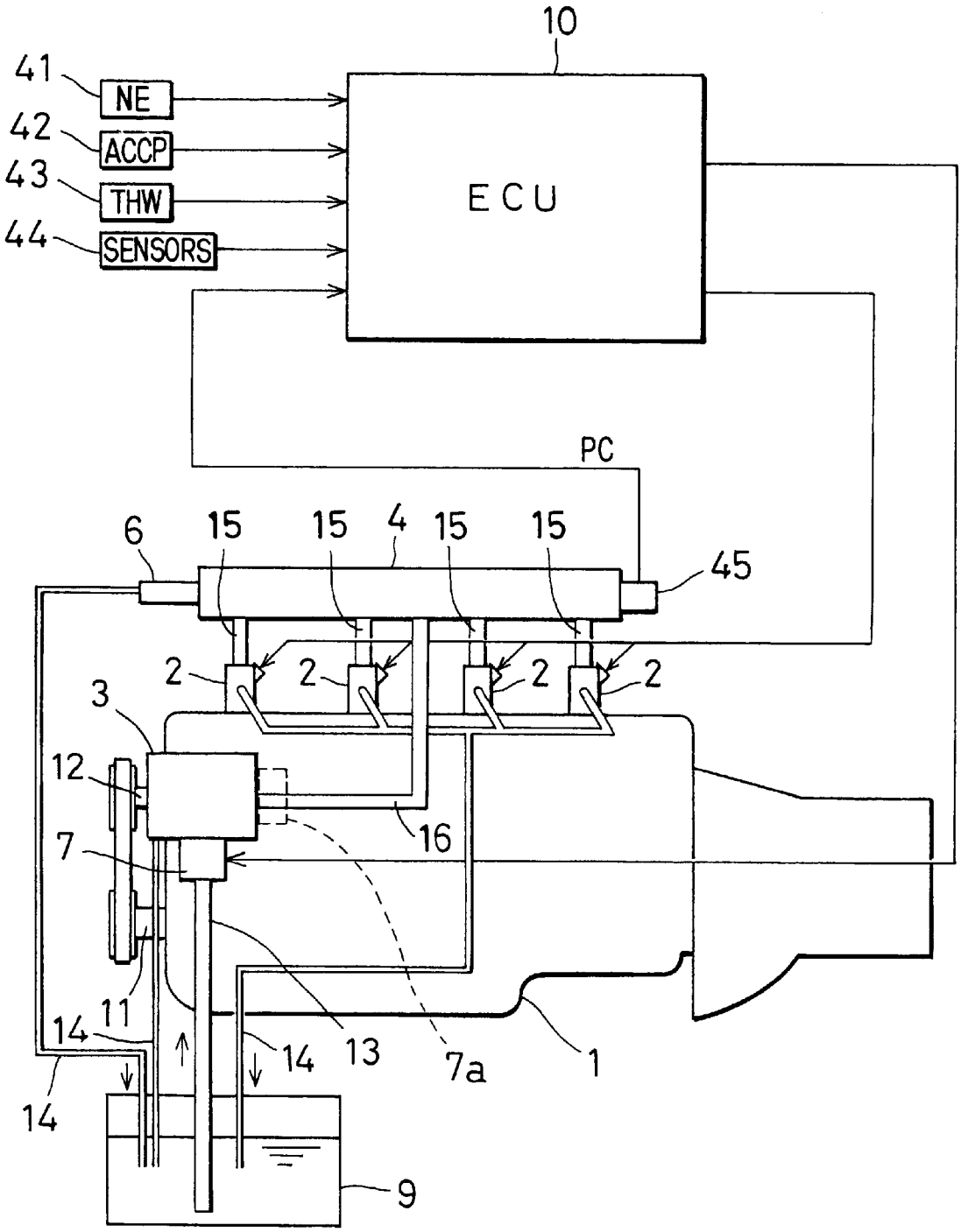
FIG. 1 is a block diagram showing a common rail type fuel injection system, according to a first embodiment of the present invention.

A plurality of embodiments of the present invention is explained by referring to the drawings.

First Embodiment

FIG. 1 is a diagram showing an overall configuration of a common rail type fuel injection system. The common rail type fuel injection system implemented by the embodiment comprises a plurality of injectors 2, a high-pressure supply pump 3, a common rail 4 and an electronic control unit 10. In this embodiment, 4 injectors 2 are employed. Each of the injectors 2 is provided for a cylinder of a multi-cylinder internal combustion engine 1 such as a multi-cylinder diesel engine. In the following description, the multi-cylinder internal combustion engine is referred to simply as a multi-cylinder engine 1. The high-pressure supply pump 3 is driven by the multi-cylinder engine 1 into rotation. The common rail 4 serves as an accumulator for accumulating high-pressure fuel discharged at a high pressure by the high-pressure supply pump 3. The electronic control unit 10 electronically controls the injectors 2 of the cylinders and the high-pressure supply pump 3. The electronic control unit 10 is referred to hereafter as an ECU 10. The common rail type fuel injection system also has a pressure safety valve 6 used as a pressure limiter 6 for suppressing the pressure of fuel in the common rail 4 to a level below a limit setting pressure by entering an opened valve state when the pressure of fuel in the common rail 4 exceeds the limit setting pressure. The pressure of fuel in the common rail 4 is also referred to hereafter as a common rail pressure.

The injectors 2 of the cylinders are each a fuel injection nozzle connected to a high-pressure pipe linked to the downstream end of a branch pipe 15 branching from the common rail 4. There are employed as many branch pipes 15 as the injectors 2. Each of the injectors 2, which each serve as a fuel injection nozzle, supplies by injection high-pressure fuel accumulated in a pressurized state in the common rail 4 to a combustion chamber of a cylinder provided on the multi-cylinder engine 1 for the injector 2. Injection of fuel from the injectors 2 to the multi-cylinder engine 1 is electronically controlled by turning on and off an injection control electromagnetic valves serving an electromagnetic actuators provided on the branch pipes 15. The injection control electromagnetic valves themselves are not shown in the figure. That is, when the injection control electromagnetic valve in an injector 2 for a cylinder of the multi-cylinder engine 1 is in an open state, high-pressure fuel accumulated in the common rail 4 in a pressurized state is injected into a combustion chamber of the cylinder.

The high-pressure supply pump 3 has a commonly known feed pump not shown in the figure, a plunger and a plunger chamber. Driven by a pump driving shaft 12 rotated by the revolution of a crankshaft 11 of the multi-cylinder engine 1, the feed pump serves as a low-pressure supplying pump used for pumping up fuel from a fuel pump 9. The feed pump is also referred to as a low-pressure feed pump. Also omitted from the figure, the plunger is driven by the pump driving shaft 12 as well. Also not shown in the figure, the plunger chamber functions as a pressure-applying chamber for applying a pressure to fuel as a result of a reciprocating motion of the plunger.

The high-pressure supply pump 3 serves as a supply pump for applying a pressure to fuel sucked out by the low-pressure supply pump from a fuel pipe 13 and discharging the high-pressure fuel to the common rail 4 from a discharge port. An inlet metering valve 7 is provided on the inlet side of the fuel route leading to the pressure-applying chamber. The inlet metering valve 7 is used as an electromagnetic actuator for changing the volume of fuel discharged from the high-pressure supply pump 3 to the common rail 4 by opening and closing the fuel route.

In the common rail 4, a high pressure corresponding to the injection pressure needs to be sustained continuously. In order to sustain such a high pressure, the common rail 4 is connected to the discharge port of the high-pressure supply pump 3 by a fuel pipe 16, which is also a portion of a high-pressure pipe route. As described earlier, the high-pressure supply pump 3 discharges high-pressure fuel from the discharge port. It is to be noted that fuel leaking from the injectors 2, fuel leaking from a pressure limiter 6 and fuel leaking from the high-pressure supply pump 3 are returned to the fuel tank 9 by way of a leak pipe 14, which is a low-pressure route. The fuel pressure in the common rail 4 is also referred to as a common rail pressure.

Figure 2:
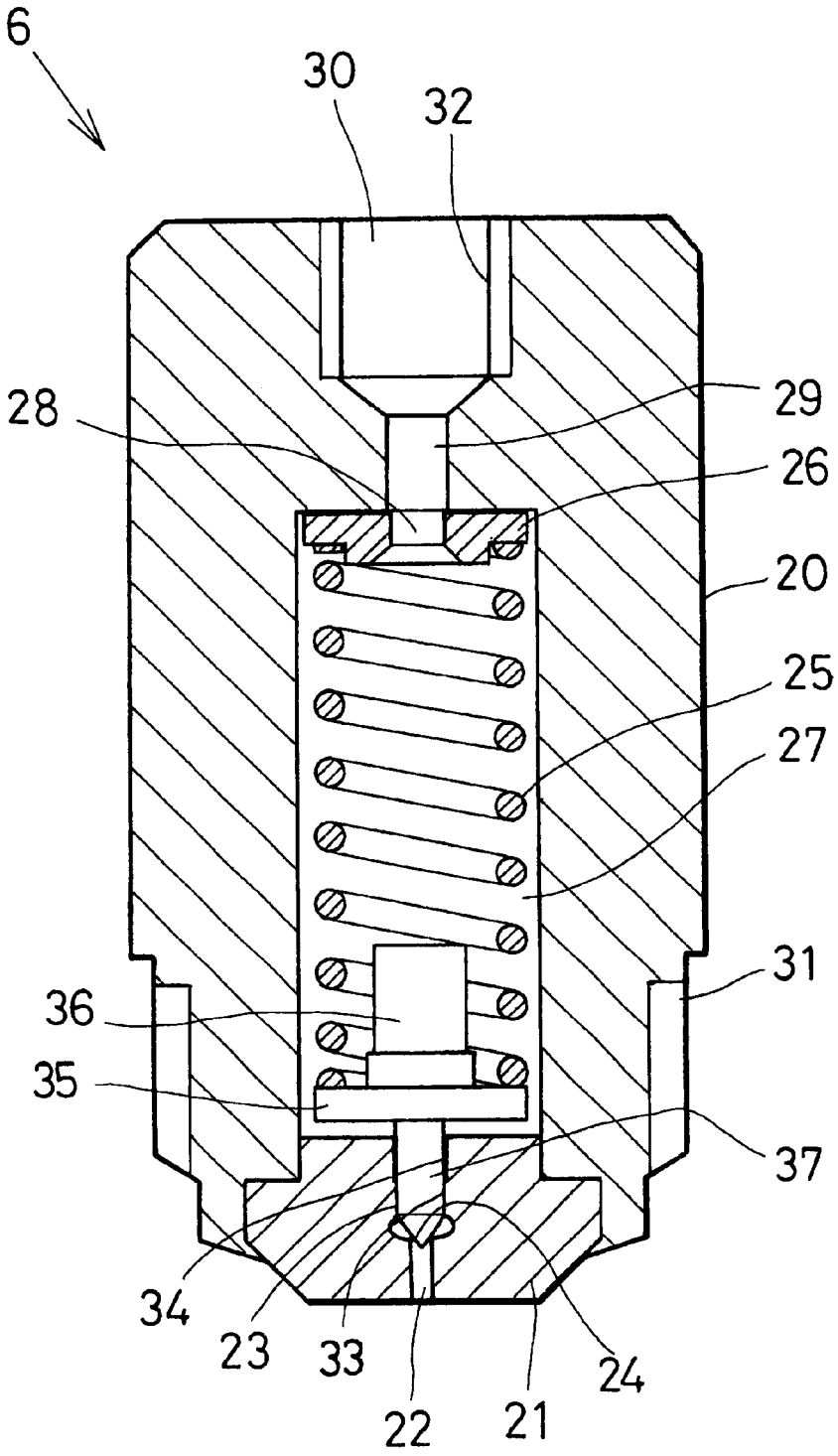
FIG. 2 is a cross sectional view showing a pressure limiter according to the first embodiment of the present invention.

As sown in FIG. 2, the pressure limiter 6 comprises a housing 20, a valve body 21, a valve needle 23 and a spring 25. The housing 20 is hermetically connected between the left end of the common rail 4 and the upper end of the leak pipe 14 so that no liquid should leak out. The valve body 21 is attached to an end of the housing 20 so that the valve body 21 is located between the housing 20 and the common rail 4. The valve needle 23 opens and closes a valve hole 22 provided on the valve body 21. The spring 25 applies a predetermined pressing force to the valve needle 23 toward a valve seat 24 to be seated on the valve seat 24 to close the valve hole 22.

In the housing 20, there are created an inlet side fuel hole 27, a small diameter hole 29 and an outlet side fuel hole 30. A fuel hole 28 is formed through a spring sheet 26 provided on the top of the inlet side fuel hole 27. The spring sheet 26 serves as a shim for adjusting the pressure to open the valve of the pressure limiter 6. On the outer circumference of the bottom of the housing 20, a male screw portion 31 is created to be engaged with a link portion of the common rail 4. The link portion itself is shown in none of the figures. On the inner circumference of the outlet side fuel hole 30 on the rear end of the housing 20, a female screw portion 32 is created to be engaged with a link portion of the leak pipe 14. The rear end of the housing 20 is the upper end shown in the figure and the link portion of the leak pipe 14 is not shown in the figure.

On the downstream side relative to the valve hole 22 of the valve body 21, a slide hole 33 is created for holding a shaft shaped portion 37 of the valve needle 23 in such a way that the shaft shaped portion 37 can be sled along the slide hole 33 with a high degree of freedom. Two or more shaft direction cut grooves 34 are created at intervals or at symmetrical locations so that, with the shaft shaped portion 37 of the valve needle 23 lifted from the valve seat 24, fuel can pass through a gap between the shaft shaped portion 37 and the slide hole 33.

The end of the shaft shaped portion 37 of the valve needle 23 is created to form a conical shape. When the outer surface of the conical shape is seated on the valve seat 24, the pressure limiter 6 is put in a closed valve state. On the top of the inlet side fuel hole 27 of the valve needle 23, a plunger portion 35 and a shaft shaped portion 36 are created as an integrated assembly. The plunger portion 35 has a diameter greater than that of the shaft shaped portion 37 and the shaft shaped portion 36 has a diameter than that of the plunger portion 35. One end of the spring 25 is held on the rear surface of the plunger portion 35 of the valve needle 23 and the other end is held on an end surface of the spring sheet 26.

A force to open the valve of the pressure limiter 6 is determined by the sheet diameter of the valve needle 23 and the set weight of the spring 25. After the pressure limiter 6 is put in an opened valve state by a common rail pressure exceeding a limit setting pressure, the common rail pressure will drop to a level not higher than a predetermined pressure, and would naturally put the pressure limiter 6 in a closed valve state. In the case of this embodiment, however, the pressure limiter 6 is provided with a pressure regulating function. With this function, once the pressure limiter 6 is put in an opened valve state, the pressure limiter 6 is capable of controlling a pressure for closing the valve of the pressure limiter 6 so as to maintain the common rail pressure at a regulated pressure required to put the vehicle in a continued running state for the purpose of letting the vehicle enter a limp home state in the event of an emergency requiring an urgent rescue such as an excessive pressure feed of high-pressure fuel supplied by the high-pressure supply pump 3 to the common rail 4.

In order to put the vehicle in a limp home state, it is necessary to put the vehicle in a continued running state by setting a fuel pressure for putting the vehicle in a continued running state at a level higher than an operating pressure of the injectors 2 so that fuel can be injected from the injectors 2 to the cylinders employed in the multi-cylinder engine 1, but at such a sufficiently low level that engine vibration, vehicle undesirable behaviors, a noise, a knocking sound and the like are not generated. Let this fuel pressure be referred to as a regulated pressure. This regulated pressure is determined by the diameter of the shaft shaped portion 37 of the valve needle 23 and the force of the spring 25 for pushing the valve needle 23 in a direction to close the valve of the pressure limiter 6. That is, the pressure to close the valve of the pressure limiter 6 is controlled proportionally to the square of the sheet diameter of the shaft shaped portion 37 of the valve needle 23. As described above, the sheet diameter determines the pressure to open the valve of the pressure limiter 6.

The inlet metering valve 7 is electronically controlled by a control signal serving as a pump driving signal originated from the ECU 10 by way of a pump driving circuit (EDU) not shown in the figure to change a pressure in the common rail 4. The inlet metering valve 7 is used for adjusting the inlet volume of fuel inhaled into the pressure-applying chamber of the high-pressure supply pump 3. Referred to also as a common rail pressure, the pressure in the common rail 4 corresponds to an injection pressure or a fuel pressure at which fuel is supplied by injection from the injectors 2 to the multi-cylinder engine 1. The inlet metering valve 7 is an electromagnetic valve functioning as a pump flow control valve of the normally open type, which puts the inlet metering valve 7 in a completely open state when there is no current conduction.

The ECU 10 comprises functional components such as a power supply circuit, an injector driving circuit and a pump driving circuit in addition to a microcomputer, which has a commonly known configuration including a CPU for executing various kinds of control and carrying out various kinds of processing, a ROM for storing a variety of programs and constants, a RAM for storing various kinds of data, an input circuit and an output circuit. Sensor signals generated by a variety of sensors are supplied to the microcomputer after being subjected to an A/D conversion process carried out in an A/D converter.

Furthermore, the ECU 10 also includes an injection volume and injection timing determination means, an injection pulse width determination means and an injector driving means. The injection volume and injection timing determination means determines a target injection timing optimum for the operating state of the multi-cylinder engine 1 and determines a target injection volume of fuel injected from each of the injectors 2 to the multi-cylinder engine 1. The target injection timing may be indicated by an injection start timing. The target injection volume may be indicated by an injection period and the common rail pressure. The injection pulse width determination means determines an injector injection pulse's duration proper for the operating state of the multi-cylinder engine 1 and the target injection volume. The injector injection pulse's duration is the same as an injection pulse width. The injector driving means supply the injector injection pulse to an injection control valve employed in each of the injectors 2 by way of the injector driving circuit (EDU).

That is, the ECU 10 computes a target injection volume on the basis of engine operating information such as an engine rotational speed detected by an engine speed sensor 41 and an accelerator position ACCP detected by an accelerator position sensor 42. The engine rotation speed is referred to hereafter as an engine speed NE. The ECU 10 supplies an injector injection pulse, which has an injection pulse width computed from the operating state of the multi-cylinder engine 1 and the target injection volume, to an injection control electromagnetic valve employed in the injector 2 of each cylinder. In this way, the multi-cylinder engine 1 is run.

In addition, the ECU 10 also serves as a discharge volume control means for computing a target common rail pressure Pt corresponding to a fuel injection pressure proper for the operating state of the multi-cylinder engine 1 and for driving the inlet metering valve 7 of the high-pressure supply pump 3 through the pump driving circuit EDU. That is, the ECU 10 computes a target common rail pressure Pt by additional correction based on the engine operating information and an engine cooling water temperature THW detected by a cooling water temperature sensor 43. As described above, the engine operating information includes an engine speed NE detected by the engine speed sensor 41 and an accelerator position ACCP detected by the accelerator position sensor 42. The ECU 10 drives the inlet metering valve 7 of the high-pressure supply pump 3 in order to achieve the target common rail pressure Pt.

Thus, this embodiment computes a target injection volume, an injection timing and a target common rail pressure by using the engine speed sensor 41, the accelerator position sensor 42 and the cooling water temperature sensor 43 as engine operating state detection means for detecting an engine operating state of the multi-cylinder engine 1. The target injection volume, the injection timing and the target common rail pressure may also be corrected on the basis of other engine operating information represented by detection signals generated by other sensors each also serving as an operating state detection means. The other sensors include an intake temperature sensor, a fuel temperature sensor 44, an intake pressure sensor, a cylinder identifying sensor and an injection timing sensor.

In addition, it is desirable to further provide the common rail 4 with a common rail pressure sensor 45 used as a fuel pressure sensor for detecting an actual common rail pressure Pc, which is an actual fuel injection pressure required for supplying pressure by injection from the injector 2 of each cylinder to the multi-cylinder engine 1. It is also desirable to execute feedback control on the inlet metering valve 7 of the high-pressure supply pump 3 so as to take the actual common rail pressure Pc detected by the common rail pressure sensor 45 to a value all but equal to a target common rail pressure Pt, which is determined in accordance with the operating state of the multi-cylinder engine 1.

In addition, the ECU 10 also includes an engine control means for executing idle up control to sustain an opened valve state of the valve needle 23 of the pressure limiter 6 by raising an idle rotation speed to a level not lower than a predetermined pressure when an abnormal increase in actual common rail pressure Pc caused by a failure of the inlet metering valve 7 of the high-pressure supply pump 3. The idle rotation speed is referred to hereafter as an idle revolution speed.

Control Method of the Embodiment

Figure 3:
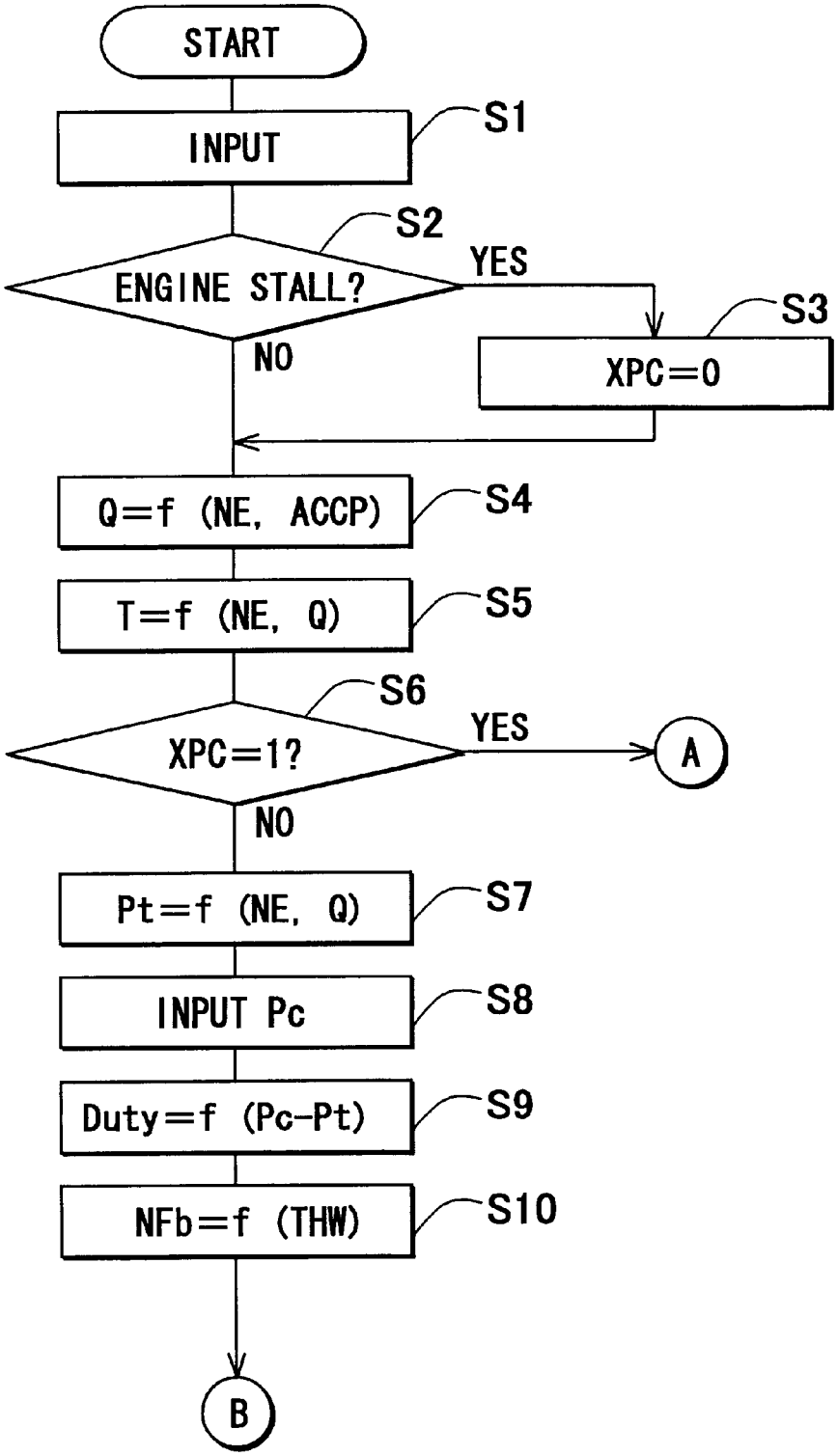
FIG. 3 shows a flowchart showing a control method of the common rail type fuel injection system according to the first embodiment of the present invention.
Figure 4:
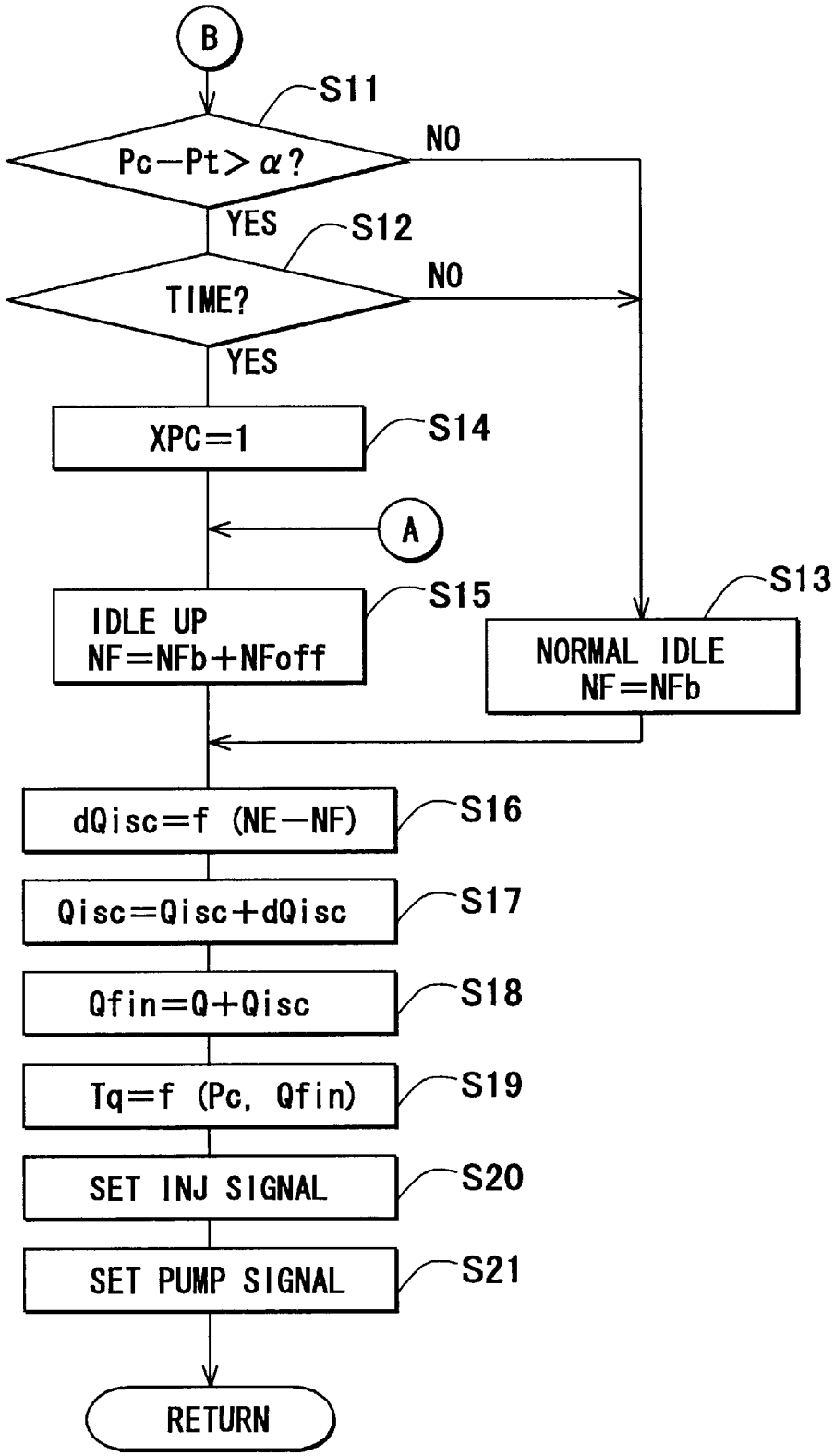
FIG. 4 shows a flowchart showing a control method of the common rail type fuel injection system according to the first embodiment of the present invention.

By referring to FIGS. 1 to 4, the following description briefly explains a control method adopted by the embodiment implementing the common rail type fuel injection apparatus. FIGS. 3 and 4 show a flowchart representing an outline of injection volume control provided by the present invention.

The flowchart begins with a step S1 to input engine parameters representing an operating state of the multi-cylinder engine 1. The engine parameters include the engine speed NE, the accelerator position ACCP and the engine cooling water temperature THW. Then, the flow of the control goes on to a step S2 to determine whether the multi-cylinder engine 1 is in a stalled state. If the result of the determination is YES, indicating that the multi-cylinder engine 1 is in a stalled state, the flow of the control goes on to a step S3 at which an excessive pressure indication flag XPC is reset. The excessive pressure indication flag XPC may be referred to as a diagnosis flag.

If the determination result obtained at the step S2 is NO, on the other hand, the flow of the control goes on to a step S4 to find a fuel injection volume Q with the engine parameters used as a base. Concretely, a fuel injection volume Q is found from the engine speed NE and the accelerator position ACCP. Then, at the next step S5, an injection time T is found with the engine parameters used as a base. Concretely, an injection time T is found from the fuel injection volume Q and the engine speed NE. Subsequently, the flow of the control goes on to a step S6 to determine whether the diagnosis flag XPC has been set. If the result of the determination is YES, indicating an excessive pressure abnormality, the flow of the control goes on directly to a step S15.

If the determination result obtained at the step S6 is NO, on the other hand, the flow of the control goes on to a step S7 to find a target common rail pressure Pt with the engine parameters used as a base. Concretely, a target common rail pressure Pt is found from the fuel injection volume Q and the engine speed NE. Then, at the next step S8, a signal output by the common rail pressure sensor 45 is input. The signal represents an actual common rail pressure Pc as a detection value. Subsequently, the flow of the control goes on to a step S9 to find a control command value Duty of the inlet metering valve 7 for controlling the common rail voltage built up by the high-pressure supply pump 3 on the basis of a pressure deviation of the actual common rail pressure Pc from the target common rail pressure Pt. The pressure deviation may be expressed by (Pc−Pt). Then, at the next step S10, a basic idle revolution speed NFb is found from the engine cooling water temperature THW.

Subsequently, the flow of the control goes on to a step S11 to determine whether the pressure deviation (Pc−Pt) is greater than a predetermined value $\alpha$. If the result of the determination is YES, indicating that the pressure deviation (Pc−Pt) is greater than the predetermined value $\alpha$, the flow of the control goes on to a step S12 to determine whether the state of the pressure deviation (Pc−Pt) greater than the predetermined value $\alpha$ has been prevailing for at least a predetermined period of time such as 1 second.

If the determination result obtained at the step S11 or S12 is NO, indicating that the pressure deviation (Pc−Pt) is not greater than the predetermined value $\alpha$ or the state of the pressure deviation (Pc−Pt) smaller than the predetermined value $\alpha$ has not been prevailing for at least the predetermined period of time respectively, on the other hand, the flow of the control goes on to a step S13 at which an idle target NF is set at the basic idle revolution speed NFb found from the engine cooling water temperature THW. If the determination result obtained at the step S12 is YES, indicating that the state of the pressure deviation (Pc−Pt) greater than the predetermined value $\alpha$ has been prevailing for at least the predetermined period of time, on the other hand, an abnormality caused by an excessively large value of the pressure, that is, the fuel pressure or the common rail pressure determined to exist. In this case, the flow of the control goes on to a step S14 at which the diagnosis flag XPC is set.

Then, at the next step S15, the idle target revolution speed NF is newly set at an abnormality value. That is, as an abnormality handling process, the idle target revolution speed NF is raised to (NFb+NFoff). The symbol NFb denotes the basic idle target revolution speed found at the step S10. The symbol NFoff denotes a predetermined value not smaller than typically 200 rpm to be added to the basic idle target revolution NFb in the event of such an abnormality.

Subsequently, at the next step S16, a fuel injection volume correction quantity dQisc is found from a difference between the actual engine speed NE and a target value NF. Then, at the next step S17, the fuel injection volume correction quantity dQisc is added to a previous cumulative fuel injection volume correction quantity Qisc to give a current cumulative fuel injection volume correction quantity Qisc. Then, at the next step S18, the current cumulative fuel injection volume correction quantity Qisc is added to the fuel injection volume Q to give a final fuel injection volume Qfin.

Subsequently, at the next step S19, an injection pulse duration Tq is computed from the actual common rail pressure Pc and the final fuel injection volume Qfin. The injection pulse duration is equal to an injection pulse width. Then, at the next step S20, an injector injection pulse with the injection pulse width Tq found at the step S19 is set at an output stage of the ECU 10. Subsequently, at the next step S21, the control command value Duty of the inlet metering valve 7 for controlling the common rail voltage is set at the output stage of the ECU 10. As described earlier, the control command value Duty was found at the step S9. The control described above is executed repeatedly.

Characteristics of the Embodiment

Figure 7:
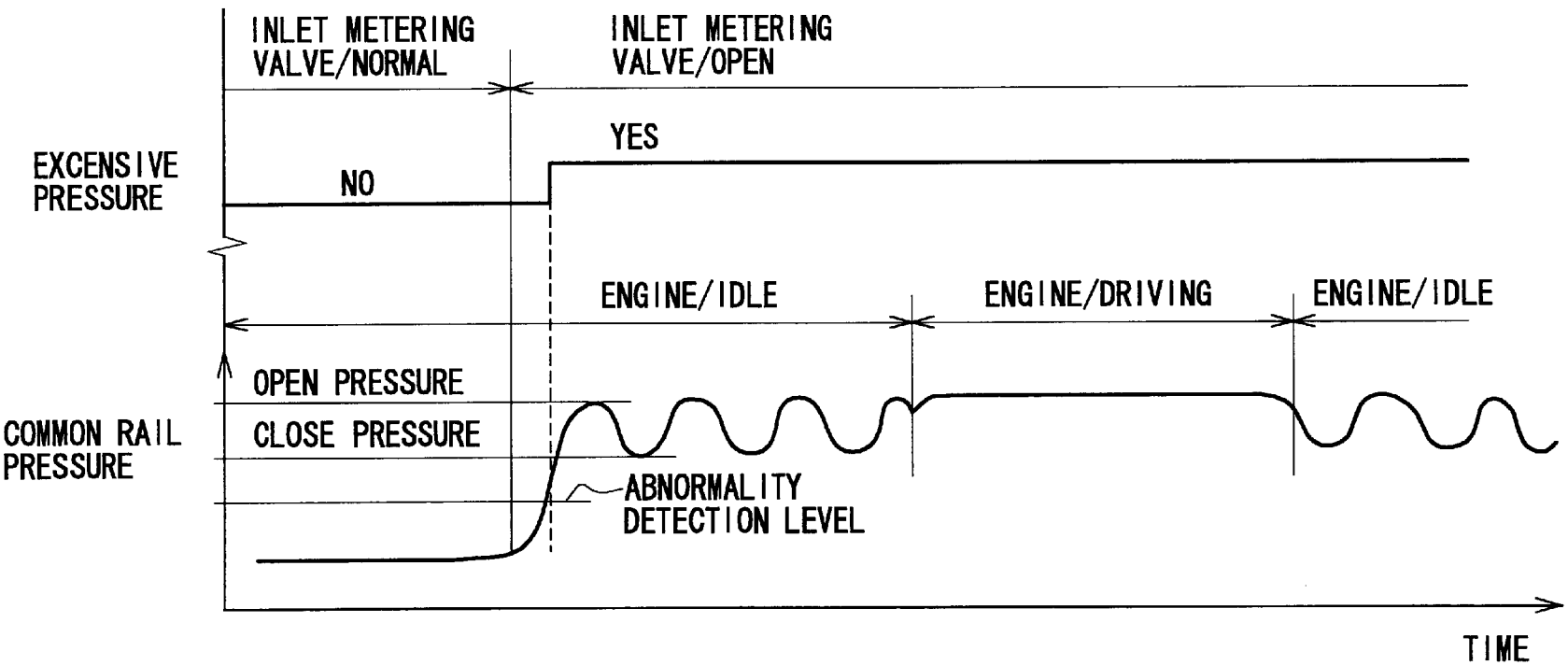
FIG. 7 is a time chart showing an operation of a fuel injection system according to a conventional technology.

In the embodiment, a completely opened state abnormality of the inlet metering valve 7 in an idle operation is detected by the ECU 10 as shown in timing charts of FIG. 7 as an excessively high pressure abnormality caused by a state in which a pressure deviation (Pc−Pt) of the actual common rail pressure Pc from the target common rail pressure Pt exceeds a predetermined value due to high-pressure fuel excessively pressure fed by the high-pressure supply pump 3 to the common rail 4, that is, a state in which the common rail pressure Pc is higher than a pressure abnormality detection level has been prevailing for at least a predetermined period of time.

Then, as the actual common rail pressure Pc increases to a level above a limit setting pressure, the shaft shaped portion 37 of the valve needle 23 employed in the pressure limiter 6 is lifted from the valve seat 24. The pressure limiter 6 is switched into an opened valve state to discharge high-pressure fuel from the common rail 4 to the fuel tank 9. The fuel tank 9 is a part of the low-pressure side component in the system. The high-pressure fuel is discharged through the valve hole 22, the inlet side fuel hole 27, the fuel hole 28, the small diameter hole 29, the outlet side fuel hole 30 and the leak pipe 14. The leak pipe 14 is a part of the low-pressure side. As a result, the pressure of fuel in the high-pressure route is suppressed to a level not higher than the limit setting pressure. The limit setting pressure is also referred to as an open pressure for the pressure limiter valve. The high-pressure route comprises the common rail 4, the branch pipe 15 and the fuel pipe 16. The branch pipe 15 and the fuel pipe 16 are parts of a high-pressure pipe.

When the multi-cylinder engine 1 is operated at a normal idle revolution speed resulting in a small amount of fuel discharged by the high-pressure supply pump 3 to the common rail 4, however, the valve needle 23 employed in the pressure limiter 6 is not capable of sustaining an opened valve state so that the common rail pressure Pc decreases to the pressure limiter valve closing level, causing the valve needle 23 employed in the pressure limiter 6 to be seated on the valve seat 24. The amount of fuel discharged by the high-pressure supply pump 3 to the common rail 4 is referred to as a supplied fuel volume. With the valve needle 23 seated on the valve seat 24, the pressure limiter 6 is put in a closed valve state, causing fuel discharged thereafter by the high-pressure supply pump 3 to the common rail 4 to be accumulated in the common rail 4. As a result, since the common rail pressure Pc again exceeds the limit setting pressure, the pressure limiter 6 reenters an opened valve state.

Thereafter, the common rail pressure Pc decreases to the pressure limiter valve closing level and again increases to a level higher than the limit setting pressure repeatedly in an alternate manner as such so that the valve needle 23 employed in the pressure limiter 6 is repeatedly put in a closed valve state and an opened valve state also in an alternate manner. As a result, the idle performance of the multi-cylinder engine 1 becomes instable and, in addition, the increased number of times the valve needle 23 employed in the pressure limiter 6 enters an opened valve state and a closed valve state alternately causes fatigue of the spring 25 employed in the pressure limiter 6 and a bad seal on the seal sheet surface, raising a problem of impossibility to assure reliability of the pressure limiter 6.

Figure 5:
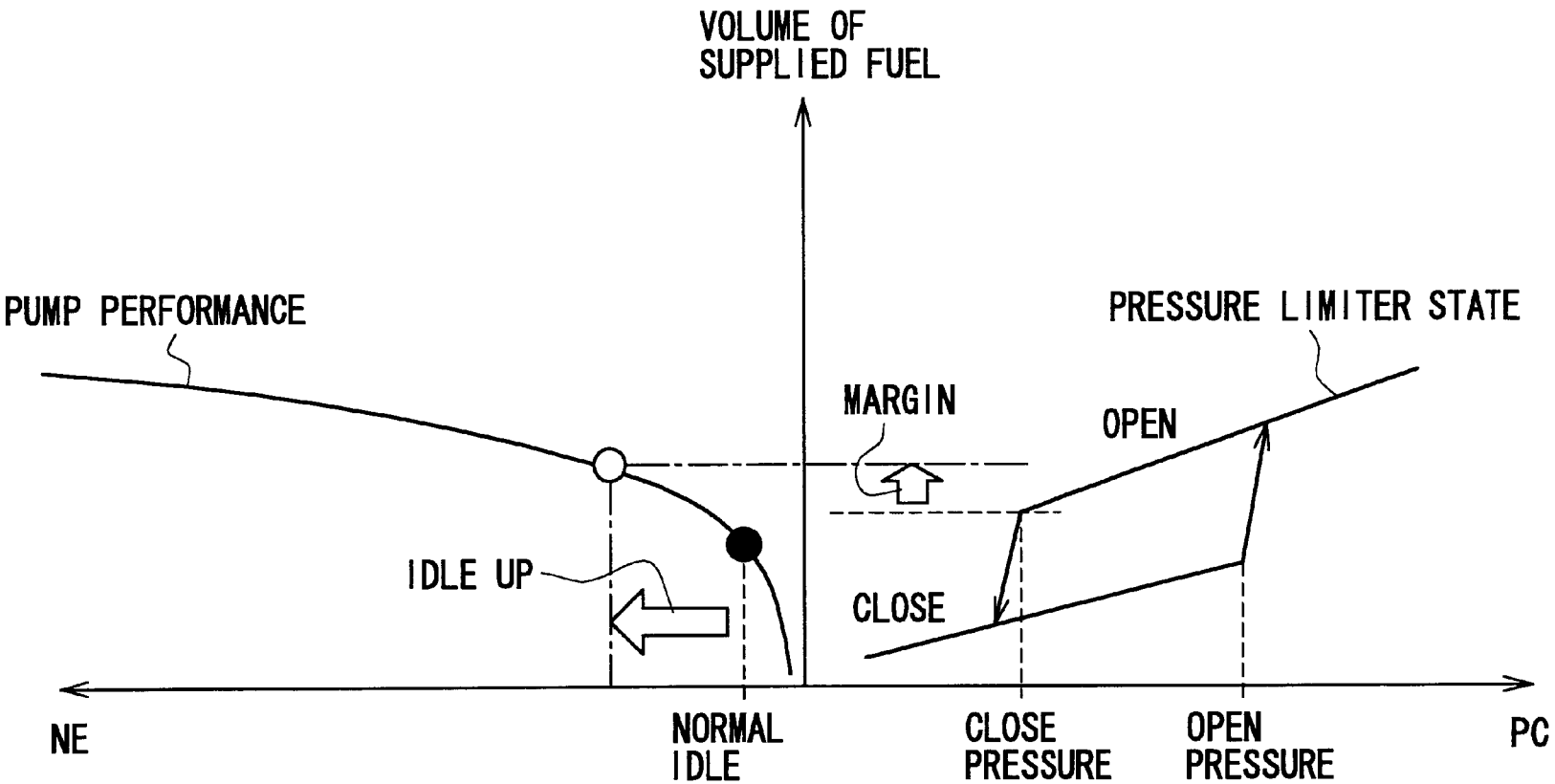
FIG. 5 is a graph showing a relationship between an engine revolution speed and the volume of supplied fuel as well as a relationship between a common rail pressure and the volume of supplied fuel, according to the first embodiment of the present invention.
Figure 6:
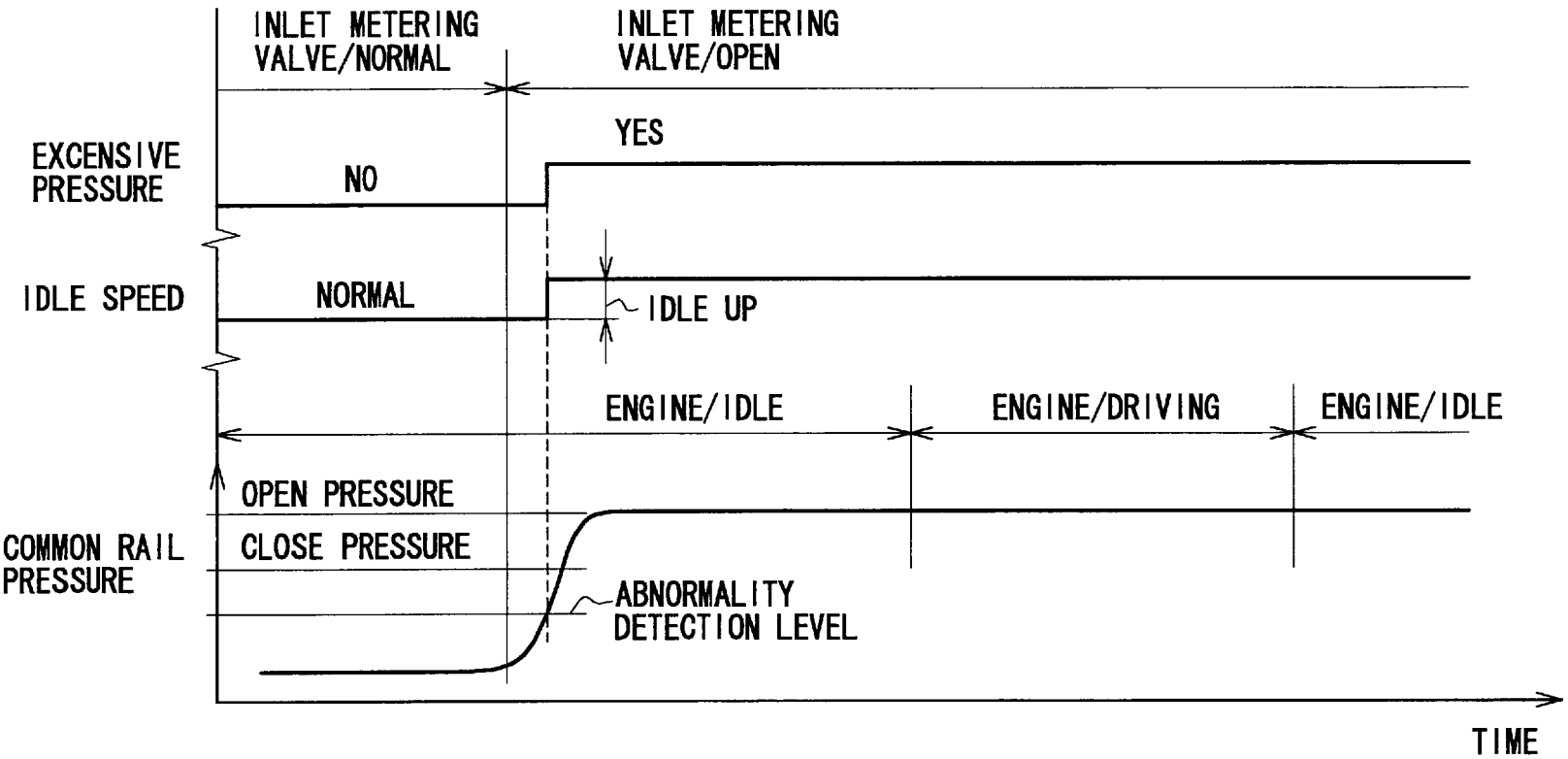
FIG. 6 is a time chart showing an operation of the fuel injection system according to the first embodiment of the present invention.

Thus, in order to solve the above problem, in the common rail type fuel injection apparatus implemented by this embodiment, when an abnormal increase in pressure is detected, the target idle revolution speed is raised to at least a value for the steady state or the normal value as shown in FIGS. 5 and 6. That is, the idle revolution speed is newly set at an abnormal value greater than a normal value for the idle state in the so-called idle revolution speed up operation. Thus, it is possible to prevent the valve needle 23 employed in the pressure limiter 6 from entering a closed valve state from an opened valve state of the pressure limiter 6, which has been once put in the opened valve state by the common rail pressure Pc exceeding the limit setting pressure due to the improved discharging performance of the high-pressure supply pump 3 driven by the multi-cylinder engine 1 into rotation. As a result, the idle performance of the multi-cylinder engine 1 can be prevented from becoming instable due to an increased number of times the valve needle 23 employed in the pressure limiter 6 enters an opened valve state and a closed valve state repeatedly, and the reliability of the pressure limiter 6 can be assured.

In addition, if the inlet metering valve 7 provided at the inlet of the high-pressure supply pump 3 is an electromagnetic valve of the normally closed type, a breakage or a short circuit of a wiring harness connecting a pump driving circuit EDU to the inlet metering valve 7 results in no fuel discharged from the high-pressure supply pump 3 so that it is impossible to sustain a common rail type fuel pressure and a fuel injection volume, that are required to operate the multi-cylinder engine 1. As a result, there is raised a problem called an engine stall. In the case of this embodiment in which an electromagnetic valve of the normally open type is employed as the inlet metering valve 7, on the contrary, a breakage or a short circuit of the wiring harness connecting the pump driving circuit EDU to the inlet metering valve 7 results in a completely opened state abnormality of the inlet metering valve 7. This abnormality in turn causes an excessive pressure feed of the high-pressure supply pump 3. That is, the abnormality causes a full discharge volume of the high-pressure supply pump 3.

Thus, as the actual common rail pressure Pc increases to a level above the limit setting pressure, the valve needle 23 employed in the pressure limiter 6 is put in an opened valve state, letting high-pressure fuel flow to the low-pressure side as described above so that the actual common rail pressure Pc again decreases to a level below the limit setting pressure. By combining the inlet metering valve 7 of the normally open type with the pressure limiter 6 having a pressure regulating function, however, once the valve needle 23 employed in the pressure limiter 6 is put in an opened valve state, the fuel injection pressure and the common rail pressure can be maintained at a regulated level required for putting the vehicle in a limp home state in the event of an emergency requiring an urgent rescue. As a result, an engine stall can be avoided and a limp home quality can be improved.

Modified Embodiments

In this embodiment, the common rail pressure sensor 45 is provided directly on the common rail 4 to be used for detecting an actual common rail pressure, that is, a pressure of fuel in the common rail 4. As an alternative, a fuel pressure detection means can also be provided typically on a fuel pipe between the plunger chamber of the high-pressure supply pump 3 and fuel routes in the injectors 2 to be used for detecting a pressure of fuel discharged from the pressurizing chamber of the high-pressure supply pump 3.

In this embodiment, the inlet metering valve 7 is provided for changing or adjusting the intake volume of fuel absorbed to the plunger chamber of the high-pressure supply pump 3. As an alternative, a discharged fuel metering valve can also be provided for changing or adjusting the volume of fuel discharged from the plunger chamber of the high-pressure supply pump 3 to the common rail 4. Referring to FIG. 1, a discharged fuel metering valve 7*a* may be disposed on an outlet side of the high-pressure supply pump 3 instead of the inlet metering valve 7. This embodiment employs an electromagnetic valve of the normally open type fully opening the valve in a state of no current conduction as the inlet metering valve or the discharged fuel metering valve. As an alternative, an electromagnetic valve of the normally closed type fully closing the valve in a state of no current conduction can also be employed as the inlet metering valve or the discharged fuel metering valve. In this case, a completely open state abnormality of the discharged fuel metering valve or the inlet metering valve, that is, an excessive pressure feed of high-pressure fuel supplied by the supply pump 3 to the accumulator of the common rail 4 or an abnormal pressure increase detected in the accumulator of the common rail 4, can be considered to be a state caused by an abnormality of an excessively large control voltage generated by the ECU 10 or the pump driving circuit EDU.

Second Embodiment

A second embodiment of the present invention is explained by referring to the drawings. The second embodiment has the same configuration as the first embodiment as shown in FIG. 1. The same reference numbers are used in the second embodiment.

In addition to the first embodiment, in the second embodiment, the ECU 10 also includes an operating state detection means for detecting an operating state of the supply pump 3. This operating state detection means also serves as a pressure fed volume determination means for computing a pressure fed volume of fuel discharged by the supply pump 3 to the common rail 4 from an operating state of the engine 1, the degree of opening SCVK of the inlet metering valve 7 and an actual common rail pressure Pc. An example of the operating state of the engine 1 in this computation is the engine speed NE. The pressure fed volume of fuel discharged by the supply pump 3 is also referred to as a pump pressure fed volume.

Furthermore, the ECU 10 also includes a leak quantity determination means for computing the quantity QL of a fuel leak from the high-pressure pipe route based on an operating state of the engine 1, a target injection volume Q and an actual common rail pressure Pc. The high-pressure pipe route includes passages extending from the supply pump 3 to the injectors 2 through the common rail 4. An example of the operating state of the engine 1 in this computation is the engine speed NE. Moreover, the ECU 10 also includes a leakage quantity finding means for computing the quantity Qo of a fuel leakage from the high-pressure pipe route based on an operating state of the engine 1, a pump pressure fed volume Qp and a fuel leak quantity QL. An example of the operating state of the engine 1 in this computation is the engine speed NE.

In addition, the ECU 10 also includes an engine control means for taking failsafe measures such as an action to limit the output of the engine 1 and a measure to stop the engine 1 in accordance with the level of a fuel leakage. The engine control means has a first fuel leakage determination means for determining that a detected fuel leakage quantity Qo smaller than a first predetermined value $\alpha$ is a quantity of a normal fuel leakage from the high-pressure pipe route. The engine 1 is controlled normally even if the first fuel leakage determination means detects a quantity of a normal fuel leak.

Furthermore, the engine control means has a second fuel leakage determination means for determining that a detected fuel leakage quantity Qo greater than the first predetermined value $\alpha$ but not exceeding a second predetermined value $\beta$ is a quantity of a small fuel leakage from the high-pressure pipe route. A failsafe measure such as an action to limit the output of the engine 1 is taken to let the vehicle continue its running state for the purpose of implementing limp home running of the vehicle if the first fuel leakage determination means detects a quantity of a small fuel leakage.

Moreover, the engine control means has a third fuel leakage determination means for determining that a detected fuel leakage quantity Qo smaller than the second predetermined value $\beta$ is a quantity of a large fuel leakage from the high-pressure pipe route. A failsafe measure such as an action to stop the engine 1 is taken to raise the degree of safety of the vehicle if the first fuel leakage determination means detects a quantity of a large fuel leakage. It is to be noted that, in this embodiment, a failsafe measure such as an action to limit the output of the engine 1 is taken to let the vehicle continue its running state for the purpose of implementing limp home running of the vehicle even if the first fuel leakage determination means detects a quantity of a large fuel leakage provided that an actual common rail pressure Pc exceeds a predetermined pressure level Pm as will be described later.

In addition, the engine control means has a pressure-drop or excessive-pressure-feed detection means for detecting a pressure drop caused by an opened valve state of the pressure limiter 6 or an excessive pressure feed state of the supply pump 3 for a case in which a fuel leakage quantity Qo is greater than the second predetermined value $\beta$ and an actual common rail pressure Pc is higher than the predetermined pressure level Pm. When this pressure-drop or excessive-pressure-feed detection means detects a pressure drop caused by an opened valve state of the pressure limiter 6 or an excessive pressure feed state of the supply pump 3, a failsafe measure such as an action to limit the output of the engine 1 is taken to let the vehicle continue its running state for the purpose of implementing limp home running of the vehicle.

Furthermore, the engine control means has a system abnormality detection means for detecting the high-pressure pipe route's abnormality such as a burst of a high-pressure pipe for a case in which a fuel leakage quantity Qo is greater than the second predetermined value $\beta$ and an actual common rail pressure Pc is not higher than the predetermined pressure level Pm. When this system abnormality detection means detects an abnormality of the high-pressure pipe route, a failsafe measure such as an action to stop the engine 1 is taken to raise the degree of safety of the vehicle.

Control Method of the Embodiment

Figure 8:
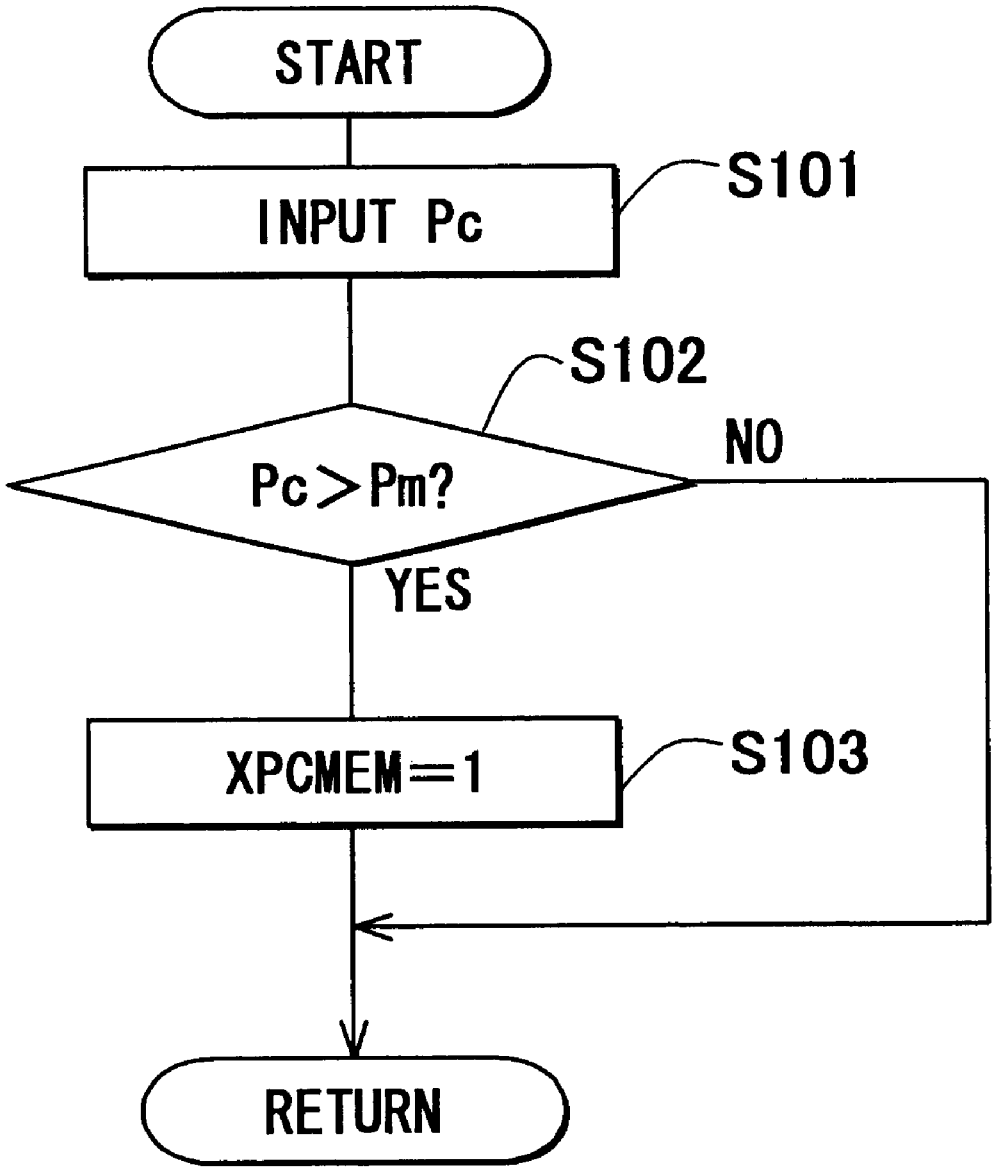
FIG. 8 is a flowchart showing a control method of the common rail type fuel injection system according to a second embodiment of the present invention.
Figure 9:
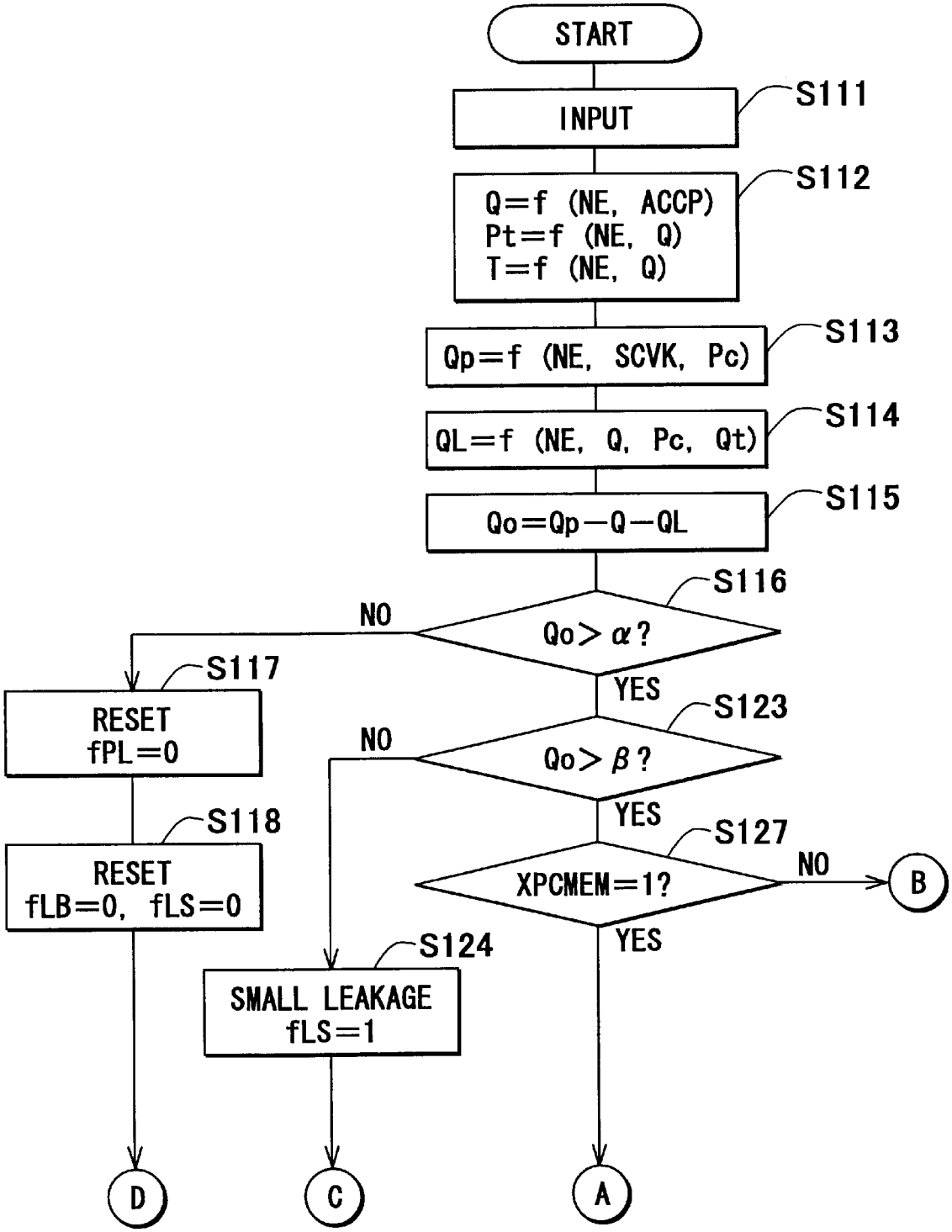
FIG. 9 is a flowchart showing a control method of the common rail type fuel injection system according to the second embodiment of the present invention.
Figure 10:
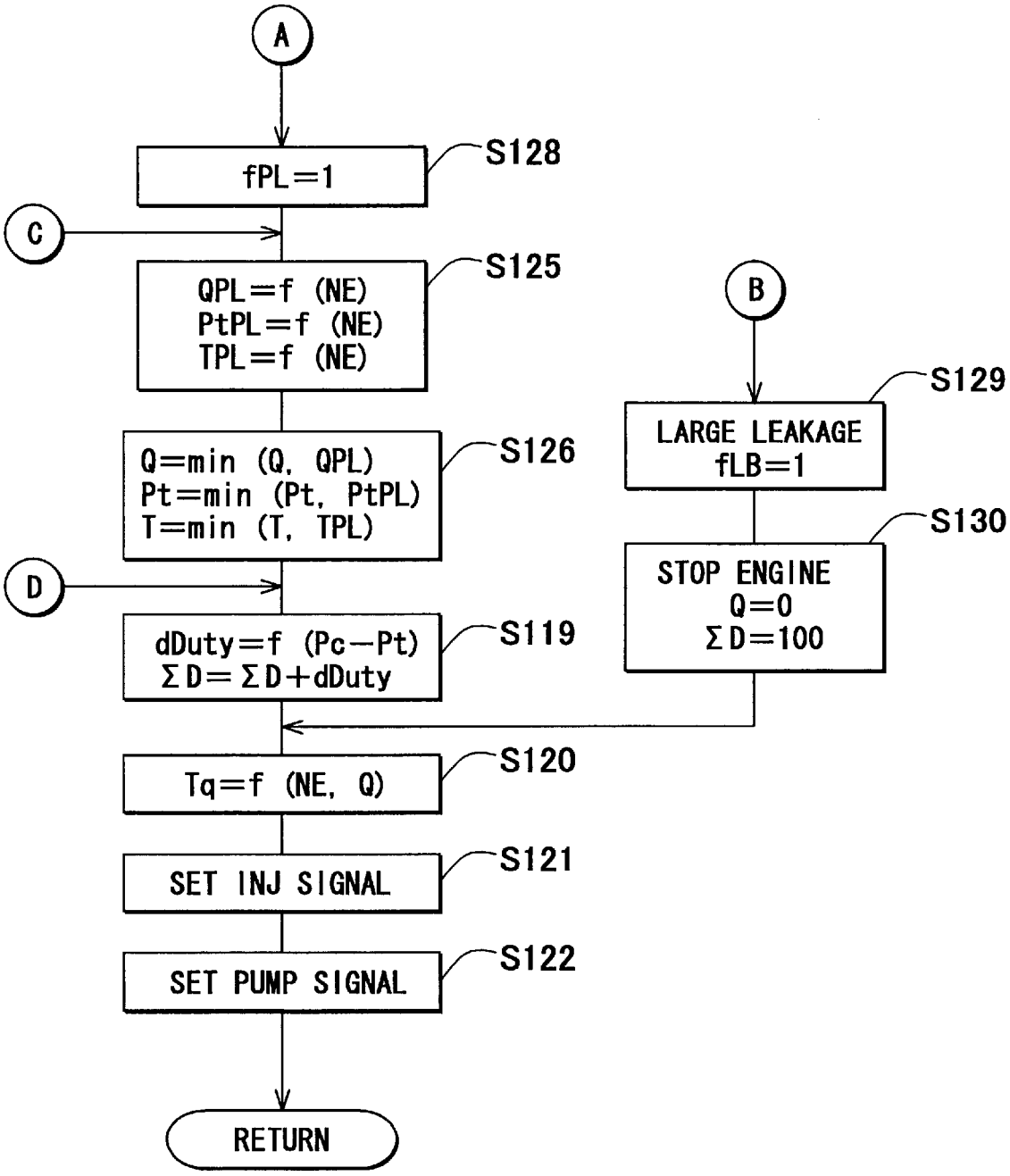
FIG. 10 is a flowchart showing a control method of the common rail type fuel injection system according to the second embodiment of the present invention.

Next, a control method adopted by the common rail fuel injection system implemented by the embodiment is explained in a simple way by referring to FIGS. 8 to 10. FIG. 8 shows a flowchart representing a subroutine for setting an abnormally high pressure history storing flag. FIGS. 9 and 10 show a flowchart representing the control method of the common rail fuel injection system provided by the present invention.

When an ignition key is turned on, the subroutine shown in FIG. 8 is activated. The subroutine shown in FIG. 8 is also activated at predetermined intervals such as an interval in the range 10 to 40 degrees CA (crank angle). It is to be noted that an abnormally high pressure history storing flag XPCMEM is reset to 0 or set initially when the ignition key is turned on from an OFF state. It is also worth noting that the subroutine shown in FIG. 8 can also be activated when the engine is in a stopped state or after the lapse of a predetermined time such as 10 seconds. The flowchart begins with a step S101 to input an actual common rail pressure Pc, which is represented by a detection signal generated by the common rail pressure sensor 45. Then, the flow of the routine goes on to a step S102 to determine whether the actual common rail pressure Pc exceeds a predetermined pressure level Pm in a typical range of 150 to 155 MPa. If the result of the determination is NO, that is, if the actual common rail pressure Pc is not higher than the predetermined pressure level Pm, the subroutine is executed repeatedly at the predetermined intervals starting with the step S101.

If the determination result obtained at the step S102 is YES, that is, if the actual common rail pressure Pc is higher than the predetermined pressure level Pm, on the other hand, the flow of the subroutine goes on to a step S103 at which the abnormally high pressure history storing flag XPCMEM is set at 1. Then, the subroutine is executed repeatedly at the predetermined intervals starting with the step S101. It is to be noted that the abnormally high pressure history storing flag XPCMEM set at 1 indicates that it is quite within the bounds of possibility that there is an excessive-pressure-feed (or a full pressure fed volume) state of the supply pump 3, a fuel escape (or a pressure drop) caused by an opened valve state of the pressure limiter 6 or the like. In this case, a failsafe measure such as an action to limit the output of the engine 1 is taken to let the vehicle continue its running state for the purpose of implementing limp home running of the vehicle.

In addition, when an ignition key is turned on, the subroutine shown in FIGS. 9 and 10 is activated. The flowchart begins with a step S111 to input engine parameters representing an operating state of the engine 1. The engine parameters include the engine speed NE, the accelerator position ACCP, the engine cooling water temperature THW and the fuel temperature Qt. Moreover, for feedback control of the pressure fed volume of the supply pump 3, that is, for feedback control of the opening degree SCVK of the inlet metering valve 7, an opening degree SCVK of the inlet metering valve 7 is also fetched at the same step. Furthermore, at this step, an actual common rail pressure Pc is also read in from the common rail pressure sensor 45.

Then, at the next step S112, engine control command variables are found with the engine parameters used as a base. Concretely, a target injection volume Q is found from the engine speed NE and the accelerator position ACCP. Then, a target common rail pressure Pt is computed from the engine speed NE and the target injection volume Q. Finally, an injection timing is determined also from the engine speed NE and the target injection volume Q.

Subsequently, at the next step S113, a pump pressure fed volume Qp representing a pressure fed volume of fuel discharged from the supply pump 3 to the common rail 4 is found with the engine parameters used as a base. Concretely, a pump pressure fed volume Qp is computed from the engine speed NE, the pump opening degree SCVK representing the degree of opening at the inlet metering valve 7 and the actual common rail pressure Pc.

Then, at the next step S114, a quantity QL of a fuel leak from the high-pressure pipe route is found with the engine parameters used as a base. Concretely, a fuel leak quantity QL is computed from the engine speed NE, the target injection volume Q, the actual common rail pressure Pc and the fuel temperature Qt. Subsequently, at the next step S115, a quantity Qo of a fuel leakage from the high-pressure pipe route is found with the engine parameters used as a base. Concretely, a fuel leakage quantity Qo is computed from the pump pressure fed volume Qp, the target injection volume Q and the fuel leak quantity QL.

Then, the flow of the routine goes on to a step S116 to determine whether the fuel leakage quantity Qo computed at the step S115 is greater than a first predetermined value $\alpha$ such as typically 20 $mm^3$/st. If the result of the determination is NO, that is, if the fuel leakage quantity Qo is not greater than the first predetermined value $\alpha$, a normal fuel leakage such as a small fuel leakage from the high-pressure pipe route is determined to exist. In this case, the flow of the subroutine goes on to a step S117 at which a PL opened flag abnormality determination flag fPL is reset to 0. The PL opened flag abnormality determination flag fPL is used to indicate whether or not an excessive-pressure-feed (or a full pressure fed volume) state of the supply pump 3 exists. Subsequently, at the next step S118, a small fuel leakage abnormality flag fLS and a large fuel leakage abnormality flag fLB are reset to 0. The small fuel leakage abnormality flag fLS is used to indicate whether or not a small quantity of a fuel leakage from the high-pressure pipe route exists. On the other hand, the large fuel leakage abnormality flag fLB is used to indicate whether or not a large quantity of a fuel leakage from the high-pressure pipe route exists.

Then, the flow of the subroutine goes on to a step S119 to find a pump control command variable, which is a value of a control command to be output to the inlet metering valve 7 of the supply pump 3. Concretely, a value of a control command to be output to the inlet metering valve 7 of the supply pump 3 is computed from a pressure difference (Pc−Pt) between the actual common rail pressure Pc and the target common rail pressure Pt. This computed pump control command variable is used as a signal duty ratio dDuty. This computed pump control command variable dDuty is then added to an existing cumulative pump control command variable ΣD to give a current cumulative pump control command variable ΣD.

Subsequently, at the next step S120, an injection pulse duration or an injection pulse width Tq of an injector pulse signal supplied to the injectors 2 is found. Concretely, an injection pulse width Tq is found from the engine speed NE and the target injection volume Q or a corrected injection volume, which is a final injection volume Q obtained as a result of correction of the target injection volume Q as will be described later. Then, at the next step S121, the injector injection pulse signal is set at an output stage of the ECU 10. The injector injection pulse signal has a pulse width equal to the injection pulse width Tq found at the step S120. Subsequently, at the next step S122, the current cumulative pump control command variable ΣD is set at an output stage of the ECU 10. The current cumulative pump control command variable ΣD has been found at the step S119. Thereafter, the subroutine is executed from the beginning to repeat the above control.

If the determination result obtained at the step S116 is YES, that is, if the fuel leakage quantity Qo is greater than the first predetermined value $\alpha$, on the other hand, the flow of the subroutine goes on to a step S123 to determine whether the fuel leakage quantity Qo is greater than a second predetermined value $\beta$ such as typically 40 $mm^3$/st. If the result of the determination is NO, that is, if the fuel leakage quantity Qo is greater than the first predetermined value$\alpha$ but not greater than the second predetermined value $\beta$, a small quantity fuel leakage from the high-pressure pipe route instead of a fuel escape caused by an opened valve state of the pressure limiter 6 is determined to exist. In this case, the flow of the subroutine goes on to a step S124 at which the small fuel leakage abnormality flag fLS is set at 1.

Then, at the next step S125, engine limit command variables (or output limit values) for limiting the outputs of the engine 1 are found with the engine parameters used as a base. Concretely, a corrected injection volume QPL, a corrected common rail pressure PtPL and a corrected injection timing TPL are found from the engine speed NE. Subsequently, at the next step S126, a final injection volume Q, a final common rail pressure Pt and a final injection timing T are found, where a final value is the smaller one of a base value found at the step S112 and a corrected value computed at the step S125. Then, the flow of the subroutine goes on to the step S119.

If the determination result obtained at the step S123 is YES, that is, if the fuel leakage quantity Qo is greater than the second predetermined value β, on the other hand, a fuel escape or a large fuel leakage from the high-pressure pipe route is determined to exist. The fuel escape is caused by an opened valve state or a valve opening operation of the pressure limiter 6. The system abnormality includes an abnormal failure of the high-pressure pipe route. An opened valve state or a valve opening operation of the pressure limiter 6 is caused by an excessive pressure feed of the supply pump 3. An example of the abnormal failure of the high-pressure pipe route is a burst of a high-pressure pipe.

In this case, the flow of the subroutine goes on to a step S127 to determine whether the abnormally high pressure history storing flag XPCMEM has been set at 1, that is, whether the actual common rail pressure Pc is higher than the predetermined pressure level Pm. If the result of the determination is YES, that is, if the abnormally high pressure history storing flag XPCMEM has been set at 1, a fuel escape caused by an opened state of the pressure limiter 6 is determined to exist. As described above, an opened valve state of the pressure limiter 6 is caused by an excessive pressure feed of the supply pump 3. In this case, the flow of the subroutine goes on to a step S28 at which the PL opened flag abnormality determination flag fPL is set at 1. Then, the flow of the subroutine goes on to a step S125 at which a failsafe measure such as an action to limit the output of the engine 1 is taken to let the vehicle continue its running state for the purpose of implementing limp home running of the vehicle.

If the determination result obtained at the step S127 is NO, that is, if the abnormally high pressure history storing flag XPCMEM has been reset to 0, on the other hand, a system abnormality is determined to exist. The system abnormality includes an abnormal failure of the high-pressure pipe route. An example of the abnormal failure of the high-pressure pipe route is a burst of a high-pressure pipe. In this case, the flow of the subroutine goes on to a step S129 at which the large fuel leakage abnormality flag fLB is set at 1 and a failsafe measure such as an action to stop the engine 1 is taken for the purpose of raising the degree of safety of the vehicle. Then, the flow of the subroutine goes on to a step S130 at which engine stop control variables are set. Concretely, the target injection volume Q is set at 0 and a pump control command variable (or the duty ratio ΣD) is set at 100%. That is, the pump control command variable is set at a value for completely closing the inlet metering valve 7. Subsequently, the flow of the subroutine goes on to a step S120 at which the injection pulse width Tq is set at 0. Then, the flow of the subroutine goes on to a step S121.

The small fuel leakage abnormality flag fLS set at 1 at the step S124 to indicate a small fuel leakage from the high-pressure pipe route, the PL opened flag abnormality determination flag fPL set at 1 at the step S128 to indicate an opened valve state abnormality of the pressure limiter 6 as well as indicate an excessive pressure feed (a full pressure fed volume) of the supply pump 3 and the large fuel leakage abnormality flag fLB set at 1 at the step S129 to indicate a large fuel leakage from the high-pressure pipe route can each be shown separately by a display means as well. An example of the display mean is an indicator lamp or an audio guide. As described above, a large fuel leakage from the high-pressure pipe route is caused by a system abnormality including an abnormal failure of the high-pressure pipe route. An example of the abnormal failure of the high-pressure pipe route is a burst of a high-pressure pipe.

Characteristics of the Embodiment

If an electromagnetic valve of the normally closed type is employed as the inlet metering valve 7 provided on the inlet side of the supply pump 3, a breakage of a wiring harness connecting the inlet metering valve 7 to the pump driving circuit will result in no discharge of fuel, making it impossible to sustain a common rail pressure required for operating the engine 1. As a result, an engine stall is generated.

Figure 11:
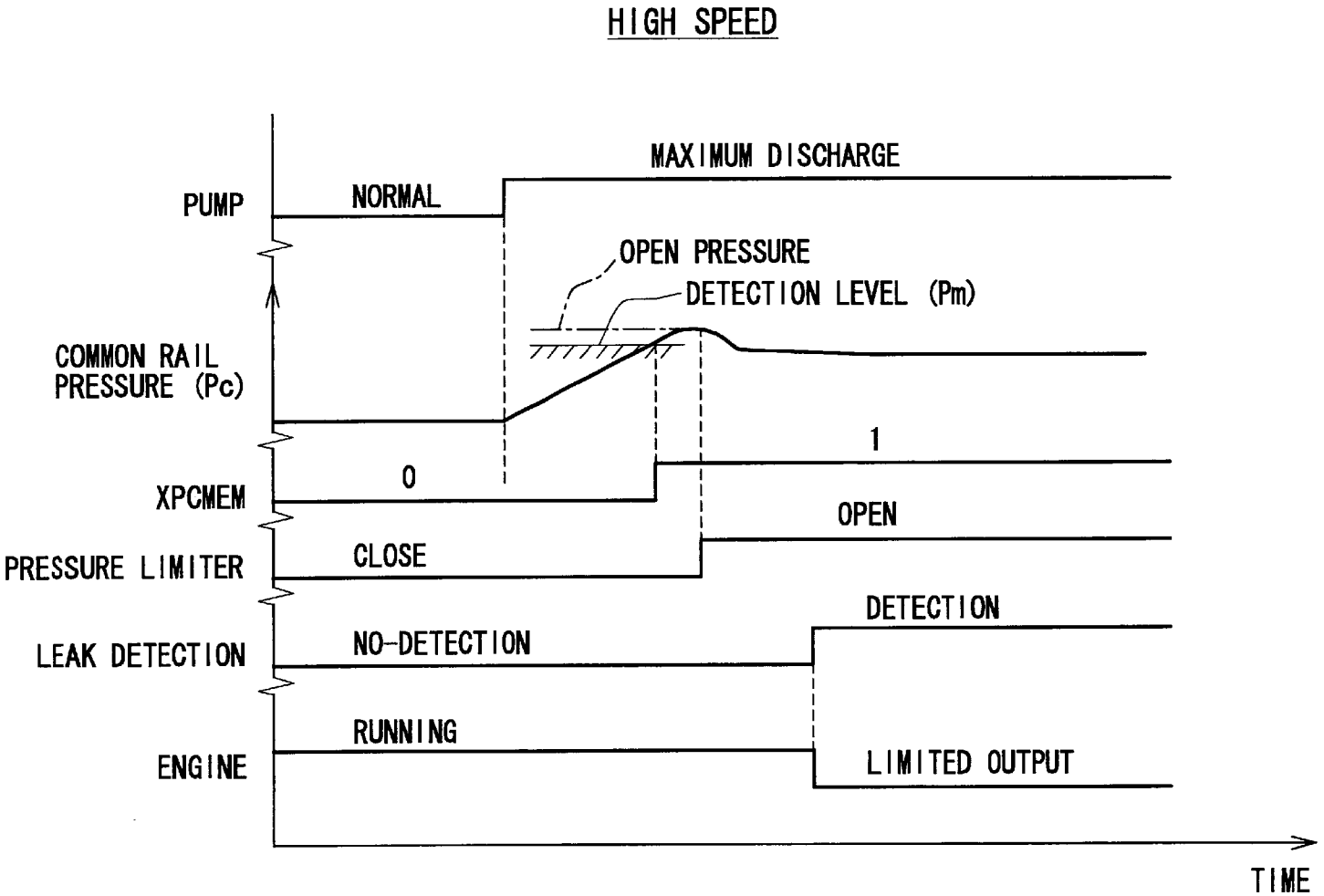
FIG. 11 is a time chart showing an operation of the fuel injection system in the case of relatively high-speed engine revolution, according to the second embodiment of the present invention.

Even if an electromagnetic valve of the normally closed type is employed as the inlet metering valve 7, a foreign material inadvertently caught between the valve body and the valve seat of the inlet metering valve 7 will mechanically put the inlet metering valve 7 in a completely but abnormally opened state. In addition, if an electromagnetic valve of the normally open type is employed as the inlet metering valve 7 as is the case with this embodiment, a breakage of a wiring harness connecting the inlet metering valve 7 to the pump driving circuit (EDU), a control abnormality of the ECU 10 or the like will electrically put the inlet metering valve 7 in a completely but abnormally opened state. Furthermore, if an electromagnetic valve of the normally open type is employed as the inlet metering valve 7, a foreign material inadvertently caught between the valve body and the valve seat of the inlet metering valve 7 will mechanically put the inlet metering valve 7 in a completely but abnormally opened state as well. With the inlet metering valve 7 put in a completely but abnormally opened state as such, the supply pump 3 will generate an excessive pressure feed or a full pressure fed volume as shown in timing charts of FIGS. 11 and 12.

Then, with the supply pump 3 generating an excessive pressure feed or a full pressure fed volume, the common rail pressure rises. When the actual common rail pressure Pc exceeds the pressure limiter detection level, that is, the predetermined pressure level Pm, the abnormally high pressure history storing flag XPCMEM is set at 1. As the actual common rail pressure Pc further exceeds a limit setting pressure or a pressure limiter valve opening pressure, the pressure limiter 6 is put in an opened valve state, flowing high-pressure fuel from the common rail 4 to the fuel tank 9 on the low-pressure side by way of the leak pipe 14, which is a portion of the low-pressure pipe route. As a result, the fuel pressure of the high-pressure pipe route including the common rail 4 and the fuel pipe 16 can be suppressed to a level not exceeding the limit setting pressure.

Figure 12:
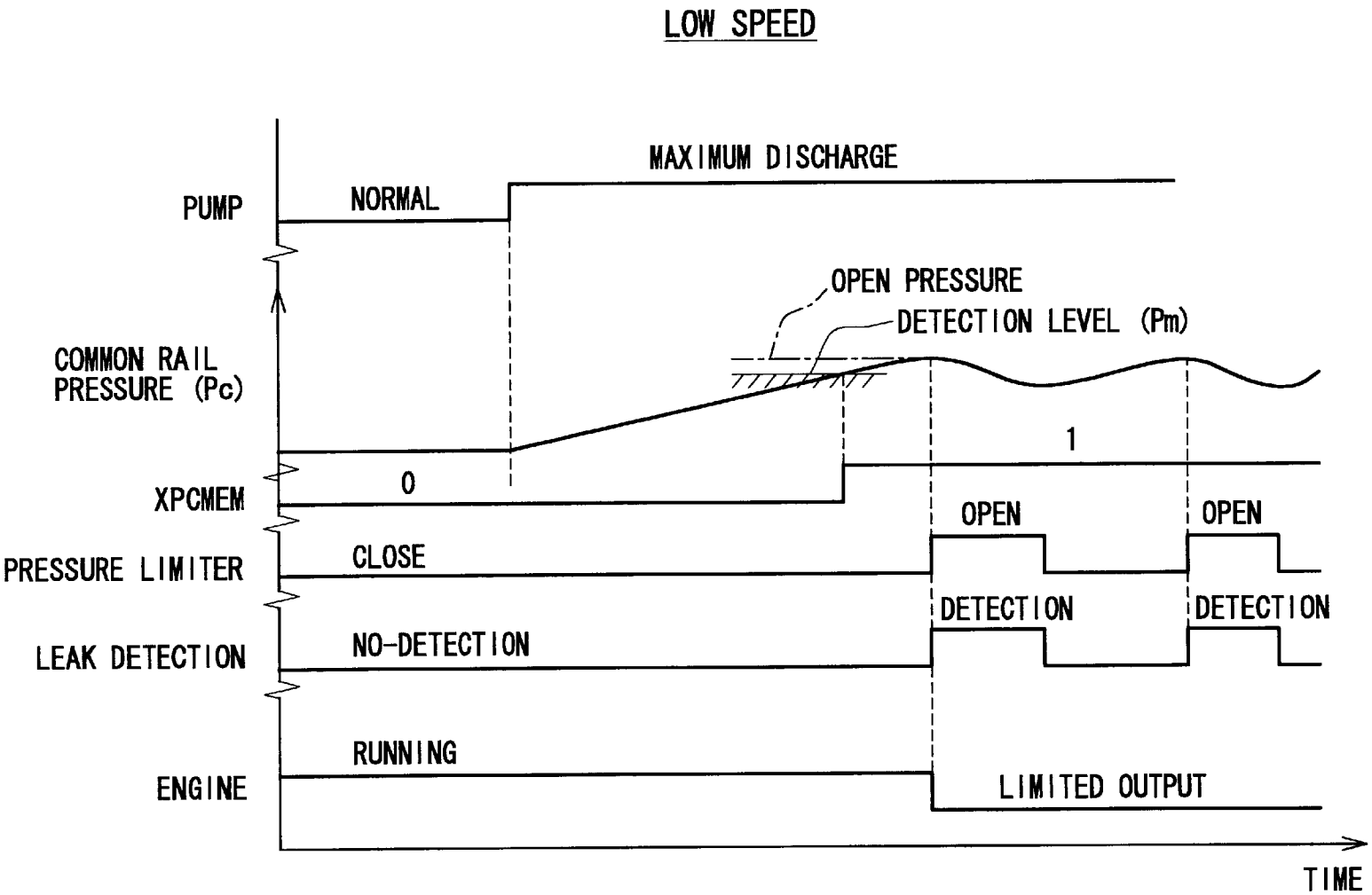
FIG. 12 is a time chart showing an operation of the fuel injection system in the case of relatively low-speed engine revolution, according to the second embodiment of the present invention.
Figure 13:
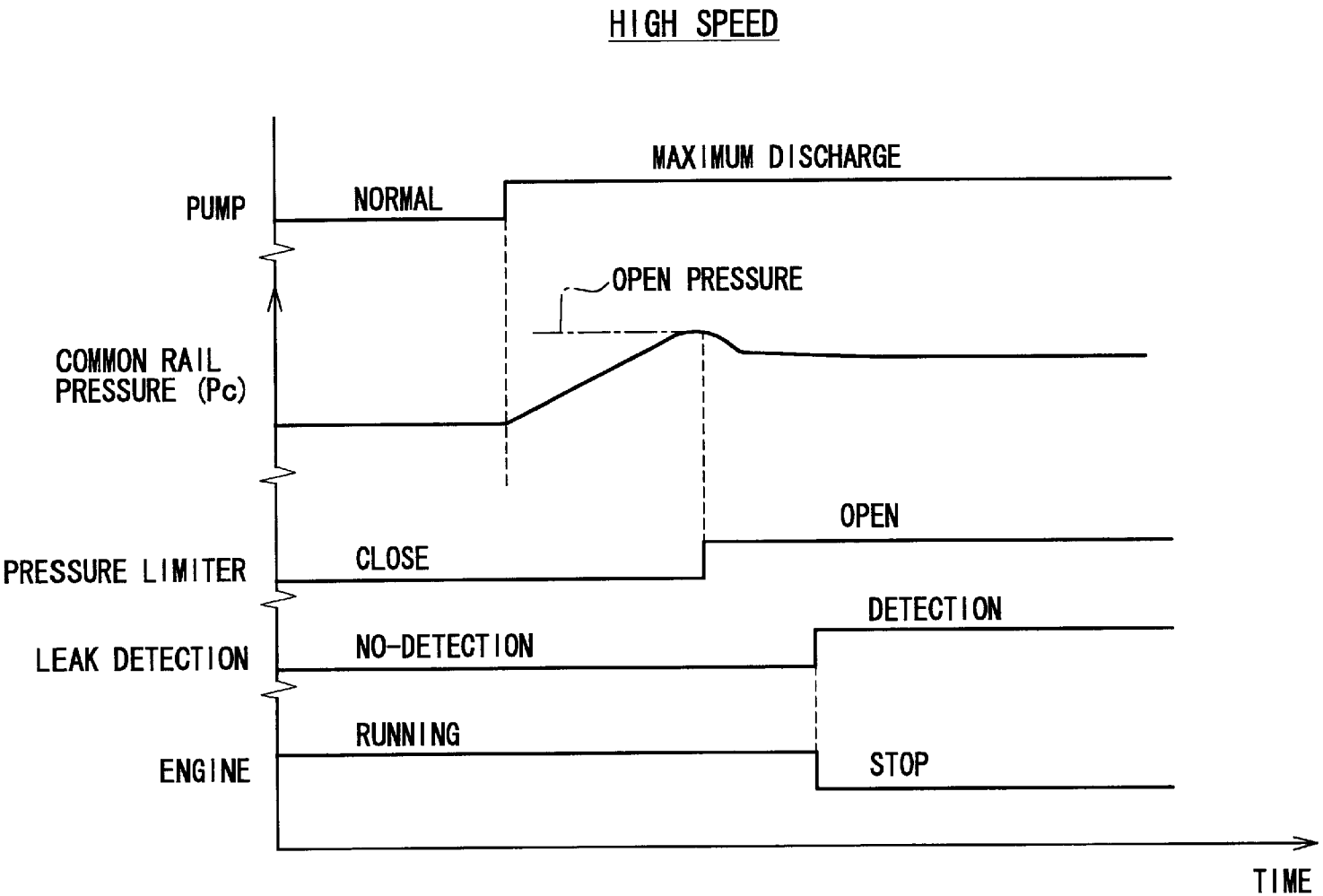
FIG. 13 is a time chart showing an operation of the fuel injection system in the case of relatively high-speed engine revolution, according to the conventional technology.
Figure 14:
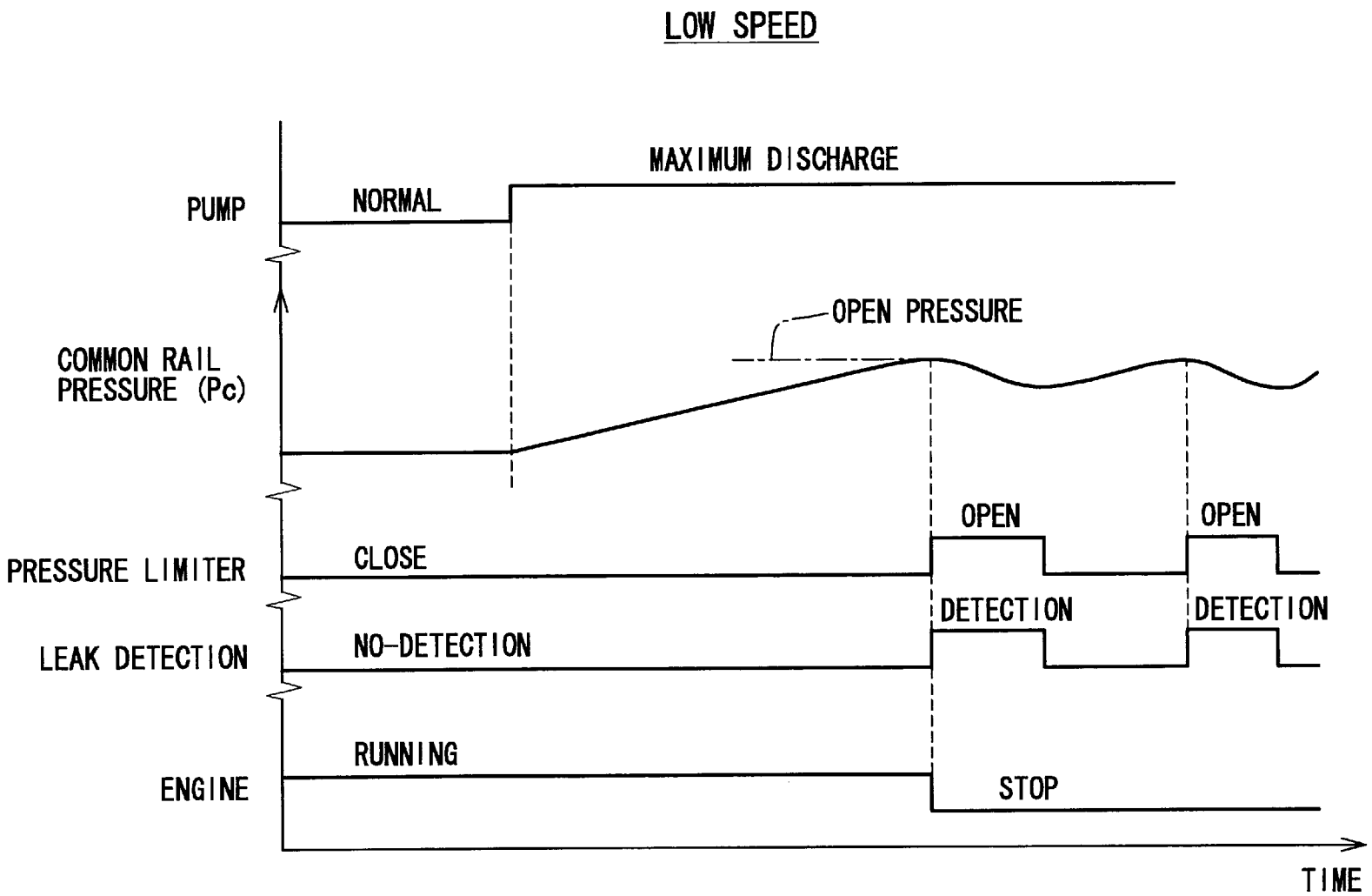
FIG. 14 is a time chart showing an operation of the fuel injection system in the case of relatively low-speed engine revolution, according to the conventional technology.

It is to be noted that, at a low engine speed resulting in a small volume (a small flow) of fuel discharged (supplied) from the supply pump 3 to the common rail 4, the pressure limiter 6 is not capable of sustaining its opened valve state and thus enters a closed valve state as shown in the timing chart of FIG. 12. This is because the actual common rail pressure Pc decreases to a level that causes the pressure limiter 6 to enter a closed valve state. With the pressure limiter 6 put in a closed valve state, fuel discharged thereafter from the supply pump 3 to the common rail 4 is stored in the common rail 4, causing the actual common rail pressure Pc to re-exceed the limit setting pressure, which drives the pressure limiter 6 to enter an opened valve state. Thereafter, the pressure limiter 6 repeatedly enters a closed valve state and an opened valve state alternately.

With the abnormally high pressure history storing flag XPCMEM set at 1 to indicate that the actual common rail pressure Pc is higher than the pressure limiter detection pressure level Pm, the ECU 10 is capable of determining that the leakage detection logic is detecting a fuel escape caused by an opened valve state (or a valve opening operation) of the pressure limiter 6 in the so-called a PL operation detection. With the abnormally high pressure history storing flag XPCMEM reset to 0 to indicate that the actual common rail pressure Pc is not higher than the pressure limiter detection pressure level Pm, on the other hand, the ECU 10 is capable of determining whether a fuel leakage is very small (normal), small or large in dependence on the level of the fuel leakage.

Thus, if the inlet metering valve 7 is electrically or mechanically put in a completely but abnormally opened state, causing the supply pump 3 to generate an excessive pressure feed or a full pressure fed volume, causing the fuel pressure in the high-pressure pipe route to exceed the limit setting level, causing the pressure limiter 6 to enter an opened valve state, resulting in a determination of a large fuel escape, a failsafe measure such as an action to limit the output of the engine 1 can be taken to let the vehicle continue its running state for the purpose of implementing limp home running of the vehicle by avoidance of a stalled engine state.

Thus, a fuel escape caused by a valve opening operation (or an opened valve state) of the pressure limiter 6 can be distinguished from a fuel leakage caused by the high-pressure pipe route's abnormal failure such as a burst of a high-pressure pipe. In addition, a pressure decrease caused by a valve opening operation (or an opened valve state) of the pressure limiter 6 can be distinguished from a variation in pressure level so that such a decrease in pressure can be separated from a leakage criterion item. Accordingly, a failsafe measure taken for such a fuel escape or such a decrease in pressure can be implemented differently from a failsafe measure taken for a fuel leakage caused by the high-pressure pipe route's abnormal failure such as a burst of a high-pressure pipe. As a result, it is possible to substantially increase the common rail fuel injection system's degree of reliability and degree of safety.

In addition, if the fuel leakage quantity Qo computed on the basis of the pump pressure fed volume Qp, the target injection volume Q and the fuel leak quantity QL is found greater than the first predetermined value $\alpha$ but not greater than the second predetermined value $\beta$, the ECU 10 confirms existence of not only a fuel escape caused by an opened valve state of the pressure limiter 6 but also a small fuel leakage from the high-pressure pipe route. In this case, a failsafe measure such as an action to limit the output of the engine 1 is taken.

Furthermore, even if the fuel leakage quantity Qo computed on the basis of the pump pressure fed volume Qp, the target injection volume Q and the fuel leak quantity QL is found greater than the second predetermined value $\beta$, the ECU 10 determines that a large fuel leakage from the high-pressure pipe route exists due to a system abnormality including the high-pressure pipe route's abnormal failure such as a burst of a high-pressure pipe provided that the actual common rail pressure Pc is not higher than the pressure limiter detection pressure level Pm. In this case, a failsafe measure such as an action to stop the engine 1 is taken to avoid dangers. In this way, in accordance with the level of the fuel leakage quantity Qo, the state of the engine 1 is controlled by taking a failsafe measure such as an action to stop the engine 1 or a failsafe measure such as an action to limit the output of the engine 1 to implement limp home running of the vehicle. As a result, it is possible to substantially increase the common rail fuel injection system's degree of reliability and degree of safety.

Modified Embodiments

In this embodiment, the common rail pressure sensor 45 is directly installed on the common rail 4 to be used for detecting an actual common rail pressure, that is, a fuel pressure built up in the common rail 4. As an alternative, a fuel pressure detection means can be provided typically on a fuel pipe between the plunger chamber (or the pressure-applying chamber) of the supply pump 3 and fuel routes in the injectors 2 to be used for detecting a pressure of fuel discharged from the pressure-applying chamber of the supply pump 3.

In this embodiment, the inlet metering valve 7 is provided for changing or adjusting the intake volume of fuel absorbed to the pressure-applying chamber of the supply pump 3. As an alternative, a discharge metering electromagnetic valve can be provided for changing or adjusting the volume of fuel discharged from the pressure-applying chamber of the supply pump 3 to the common rail 4.

In this embodiment, the discharge fuel metering electromagnetic valve or the inlet metering electromagnetic valve is a magnetic valve of the normally open type, which puts the valve in a completely open state when no current is supplied to the valve. As an alternative, the discharge fuel metering electromagnetic valve or the inlet metering electromagnetic valve can be a magnetic valve of the normally closed type, which puts the valve in a completely open state when a current is supplied to the valve. In this case, a completely but abnormally open state of the discharge fuel metering electromagnetic valve or the inlet metering electromagnetic valve, that is, an excessive pressure feed of high-pressure fuel supplied by the supply pump 3 to the accumulator of the common rail 4 or an abnormal pressure increase detected in the accumulator of the common rail 4, can be considered to be a state caused by an excessive abnormality of a control voltage generated by the ECU 10 or the pump driving circuit EDU.

This embodiment employs the pressure limiter 6 that enters a closed valve state when the pressure of fuel in the high-pressure pipe route decreases to a level not higher than a valve closing pressure. As an alternative, it is possible to employ a pressure limiter having a pressure regulating function capable of letting the vehicle continue its running state safely. To put it in detail, even at a low engine speed, once such a pressure limiter is put in an opened valve state, the pressure limiter is capable of sustaining the pressure of fuel in the high-pressure pipe route at a regulated level, that is, a level typically higher than the operating pressure of the injectors 2 but lower than a pressure that would result in engine vibrations and/or undesirable operations of the vehicle.

In this embodiment, the predetermined pressure level Pm serving as a criterion for determining an abnormally high pressure of fuel in the high-pressure pipe route is set at a value greater than the upper limit of a pressure range normally used in the common rail fuel injection system but smaller than the value of a pressure to put the pressure limiter 6 in an opened valve state. The upper limit is a pressure of typically 145 MPa whereas the pressure to put the pressure limiter 6 in an opened valve state is the so-called limit setting pressure, which has a typical value of 160 MPa. Thus, the predetermined pressure level Pm is set at a pressure typically in the range 150 to 155 MPa. As an alternative, the predetermined pressure level Pm serving as a criterion for determining an abnormally high pressure of fuel in the high-pressure pipe route is set at a value varying within a typical range of ±5 MPa in dependence of the output characteristic of the common rail pressure sensor 45 and the valve opening characteristic of the pressure limiter 6, which vary from vehicle to vehicle or from engine to engine. In this case, the most desirable predetermined pressure level Pm is 155 MPa.

Further, the idle up control in the abnormal state described in the first embodiment may be combined with the second embodiment so that the common rail pressure is maintained in constant even in the limp home operation.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A fuel injection system comprising:

a high-pressure supply pump driven by an engine for pressurizing fuel;

an accumulator for accumulating pressurized high-pressure fuel discharged by the high-pressure supply pump;

an injector for injecting high-pressure fuel to supply to the engine;

a pressure safety valve for suppressing a fuel pressure in the accumulator to a level below a limit setting pressure by entering an opened valve state when the fuel pressure in the accumulator is higher than the limit setting pressure; and an engine control means, which is used for raising an idle revolution speed to a value higher than a steady state speed when the high-pressure supply pump excessively supplies high-pressure fuel to the accumulator or when an abnormal increase in pressure is detected in the accumulator.

2. The fuel injection system according to claim 1, wherein the high-pressure supply pump has a metering valve which adjusts volume of fuel discharged from the high-pressure supply pump to the accumulator; and the engine control means raises the idle revolution speed to a value higher than the steady state speed in the event of a completely opened state abnormality of the metering valve.

3. The fuel injection system according to claim 2, wherein the metering valve is an inlet metering valve for adjusting volume of fuel introduced into the high-pressure supply pump.

4. The fuel injection system according to claim 2, wherein the metering valve is a discharged fuel metering valve for adjusting volume of fuel discharged from the discharge port of the high-pressure supply pump to the accumulator.

5. The fuel injection system according to claim 2, wherein the metering valve is a normally open type valve.

6. The fuel injection system according to claim 5, wherein the pressure safety valve regulates a fuel pressure in the common rail when the metering valve is in an abnormal state and completely opens.

7. The fuel injection system according to claim 6, wherein the metering valve is an inlet metering valve for adjusting volume of fuel introduced into the high-pressure supply pump.

8. The fuel injection system according to claim 6, wherein the metering valve is a discharged fuel metering valve for adjusting volume of fuel discharged from the discharge port of the high-pressure supply pump to the accumulator.

9. A fuel injection system comprising:

a high-pressure supply pump driven by an engine for pressurizing fuel;

an accumulator for accumulating pressurized high-pressure fuel discharged by the high-pressure supply pump;

an injector for injecting high-pressure fuel to supply to the engine;

a pressure safety valve for suppressing a fuel pressure in the accumulator to a level below a limit setting pressure by entering an opened valve state when the fuel pressure in the accumulator is higher than the limit setting pressure; and an inlet metering valve for adjusting the volume of fuel introduced into the high-pressure supply pump so as to change the volume of fuel discharged by the high-pressure supply pump to the accumulator, wherein the inlet metering valve is a normally open type electromagnetic valve that completely opens in a state of no current conduction, and the pressure safety valve has a pressure regulating function capable of sustaining the pressure of fuel in the accumulator at a regulated level in the event of an abnormality in which the inlet metering valve completely opens.

10. A fuel injection system comprising:

a high-pressure supply pump driven by an engine for pressurizing fuel;

an accumulator for accumulating pressurized high-pressure fuel discharged by the high-pressure supply pump;

an injector for injecting high-pressure fuel to supply to the engine;

a pressure safety valve for suppressing a fuel pressure in the accumulator to a level below a limit setting pressure by entering an opened valve state when the fuel pressure in the accumulator is higher than the limit setting pressure; and a discharged fuel metering valve for adjusting the volume of fuel discharged by the high-pressure supply pump to the accumulator, wherein the discharged fuel metering valve is a normally open type electromagnetic valve that completely opens in a state of no current conduction, and the pressure safety valve has a pressure regulating function capable of sustaining the pressure of fuel in the accumulator at a regulated level in the event of an abnormality in which the discharged fuel metering valve completely opens.

11. A fuel injection system, comprising:

a high-pressure supply pump driven by an engine for pressurizing fuel;

an accumulator connected with the high-pressure supply pump for accumulating the high-pressure fuel pressurized;

an injector connected with the high-pressure supply pump for supplying fuel to a cylinder of the engine;

a pressure safety valve, which is used for suppressing a fuel pressure in the high-pressure pipe route at a level not exceeding a limit setting pressure when the fuel pressure exceeds the limit setting pressure, at least the injector, the accumulator, the high-pressure supply pump, and the pressure safety valve being parts of a high-pressure pipe route;

an engine operating state detection means for detecting an operating state of the engine;

a pump operating state detection means for detecting an operating state of the high-pressure supply pump;

a fuel pressure sensor for detecting a fuel pressure in the high-pressure pipe route;

a leakage quantity finding means for finding a quantity of a fuel leakage from the high-pressure pipe route on the basis of at least one of parameters representing the engine operating state detected by the engine operating state detection means, the high-pressure supply pump operating state detected by the operating state detection means and the high-pressure pipe route fuel pressure detected by the fuel pressure sensor;

a first fuel leakage determination means, which is used for determining that a fuel leakage from the high-pressure pipe route is a normal level of fuel leakage if a fuel leakage quantity found by the leakage quantity finding means is not greater than a first predetermined value;

a second fuel leakage determination means, which is used for determining that a fuel leakage from the high-pressure pipe route is a small fuel leakage if a fuel leakage quantity found by the leakage quantity finding means is greater than the first predetermined value but not greater than a second predetermined value;

a third fuel leakage determination means, which is used for determining that a fuel leakage from the high-pressure pipe route is a large fuel leakage if a fuel leakage quantity found by the leakage quantity finding means is greater than the second predetermined value; and an engine control means, which is used for limiting an output of the engine when the second fuel leakage determination means determines that a fuel leakage from the high-pressure pipe route is a small fuel leakage and is used for stopping the engine when the third fuel leakage determination means determines that a fuel leakage from the high-pressure pipe route is a large fuel leakage.

12. The fuel injection system according to claim 11, further comprising:

an injection volume determination means for finding an injection volume of fuel injected to the engine from each of the injectors which are each provided for one of the cylinders, on the basis of the engine operating state detected by the engine operating state detection means; and a leak quantity determination means for computing a quantity of a fuel leak from a high-pressure pipe route on the basis of the engine operating state detected by the engine operating state detection means, the injection volume calculated by the fuel volume determination means and the high-pressure pipe route fuel pressure detected by the fuel pressure sensor.

13. The fuel injection system according to claim 12, wherein the operating state detection means has a pressure fed volume determination means for finding a pressure fed volume of fuel discharged by the high-pressure supply pump to the common rail; and a quantity of a fuel leakage from the high-pressure pipe route is computed on the basis of the engine operating state detected by the engine operating state detection means, a fuel injection volume calculated by the fuel volume determination means, a fuel pressure fed volume calculated by the pressure fed volume determination means and a fuel leak quantity calculated by the leak quantity determination means.

14. A fuel injection system, comprising:

a high-pressure supply pump driven by an engine for pressurizing fuel;

an accumulator connected with the high-pressure supply pump for accumulating the high-pressure fuel pressurized;

an injector connected with the high-pressure supply pump for supplying fuel to a cylinder of the engine;

a pressure safety valve, which is used for suppressing a fuel pressure in the high-pressure pipe route at a level not exceeding a limit setting pressure when the fuel pressure exceeds the limit setting pressure, at least the injector, the accumulator, the high-pressure supply pump, and the pressure safety valve being parts of a high-pressure pipe route;

an engine operating state detection means for detecting an operating state of the engine;

a pump operating state detection means for detecting an operating state of the high-pressure supply pump;

a fuel pressure sensor for detecting a fuel pressure in the high-pressure pipe route;

a leakage quantity finding means for finding a quantity of a fuel leakage from the high-pressure pipe route on the basis of at least one of parameters representing the engine operating state detected by the engine operating state detection means, the high-pressure supply pump operating state detected by the operating state detection means and the high-pressure pipe route fuel pressure detected by the fuel pressure sensor;

a pressure-decrease or excessive-pressure-feed determination means, which is used for determining existence of a pressure decrease caused by an opened valve state of the pressure safety valve or existence of an excessive-pressure-feed state of the high-pressure supply pump if a fuel leakage quantity found by the leakage quantity finding means is greater than a predetermined value and a fuel pressure detected by the fuel pressure sensor exceeds a predetermined pressure level; and an engine control means, which is used for limiting an output of the engine when the pressure-decrease or excessive-pressure-feed determination means determines existence of a pressure decrease caused by an opened valve state of the pressure safety valve or existence of an excessive-pressure-feed state of the high-pressure supply pump.

15. The fuel injection system according to claim 14, wherein the engine control means has a system abnormality determination means, which is used for determining existence of a system abnormality including an abnormal failure of the high-pressure pipe route if a fuel leakage quantity found by the leakage quantity finding means is greater than a predetermined value and a fuel pressure detected by the fuel pressure sensor is not higher than a predetermined pressure level; and the engine control means stops the engine when the system abnormality determination means determines existence of an abnormal state in the common rail fuel injection system.

16. The fuel injection system according to claim 14, wherein the predetermined pressure level is a pressure value greater than an upper limit of a range used normally in the common rail fuel injection system but smaller than the pressure safety valve opened state pressure corresponding to the limit setting pressure.

17. The fuel injection system according to claim 16, wherein the predetermined pressure level is set for each vehicle or each engine in accordance with the fuel pressure sensor output characteristic and the pressure safety valve opening characteristic, which vary from vehicle to vehicle or from engine to engine.

18. The fuel injection system according to claim 14, further comprising:

an injection volume determination means for finding an injection volume of fuel injected to the engine from each of the injectors which are each provided for one of the cylinders, on the basis of the engine operating state detected by the engine operating state detection means; and a leak quantity determination means for computing a quantity of a fuel leak from a high-pressure pipe route on the basis of the engine operating state detected by the engine operating state detection means, the injection volume calculated by the fuel volume determination means and the high-pressure pipe route fuel pressure detected by the fuel pressure sensor.

19. The fuel injection system according to claim 18, wherein the operating state detection means has a pressure fed volume determination means for finding a pressure fed volume of fuel discharged by the high-pressure supply pump to the common rail; and a quantity of a fuel leakage from the high-pressure pipe route is computed on the basis of the engine operating state detected by the engine operating state detection means, a fuel injection volume calculated by the fuel volume determination means, a fuel pressure fed volume calculated by the pressure fed volume determination means and a fuel leak quantity calculated by the leak quantity determination means.

* * * * *